US009617748B2

(12) United States Patent
Wilson et al.

(10) Patent No.: US 9,617,748 B2
(45) Date of Patent: Apr. 11, 2017

(54) MODULAR HOUSING UNITS, REUSABLE SUPPORT STRUCTURE, AND UTILITY CONNECTOR

(71) Applicant: Kasita, LLC, Boerne, TX (US)

(72) Inventors: Jeff Wilson, Austin, TX (US); Taylor Wilson, Austin, TX (US)

(73) Assignee: Kasita, LLC, Boerne, TX (US)

( * ) Notice: Subject to any disclaimer, the term of this patent is extended or adjusted under 35 U.S.C. 154(b) by 0 days.

(21) Appl. No.: 14/874,458

(22) Filed: Oct. 4, 2015

(65) Prior Publication Data

US 2016/0312485 A1 Oct. 27, 2016

Related U.S. Application Data

(60) Provisional application No. 62/218,975, filed on Sep. 15, 2015, provisional application No. 62/150,363, filed on Apr. 21, 2015.

(51) Int. Cl.
*E04H 1/04* (2006.01)
*E04B 1/348* (2006.01)
(Continued)

(52) U.S. Cl.
CPC ..... *E04H 1/005* (2013.01); *E04B 1/34336* (2013.01); *E04B 1/34352* (2013.01);
(Continued)

(58) Field of Classification Search
CPC E04H 1/04; E04H 1/005; E04H 1/125; E04B 1/34807
See application file for complete search history.

(56) References Cited

U.S. PATENT DOCUMENTS 2,499,498 A * 3/1950 Hammond, Jr. .... E04B 1/34807 414/277
3,388,512 A * 6/1968 Newman ..... E04B 1/3404 52/125.2
(Continued)

FOREIGN PATENT DOCUMENTS

DE 2719953 A1 * 7/1978 ..... E04B 1/34807
DE 4024497 A1 * 2/1992 ..... B63B 29/025
(Continued)

OTHER PUBLICATIONS

"Laboratoire Urbanisme Insurrectionnel: Architecture Mobile," downloaded from http://laboratoireurbanismeinsurrectionnel.blogspot.fr/2012/10/architecturemobile.html on Jul. 29, 2015, pp. 1-30.
(Continued)

*Primary Examiner* — Christine T Cajilig
(74) *Attorney, Agent, or Firm* — Michael Best & Friedrich LLP

(57) ABSTRACT

A system, process and device include reusable rack that supports a number of prefabricated modular housing units, each of the plurality of prefabricated modular housing units includes: a modular unit electrical subsystem; a modular unit potable water subsystem; a modular unit wastewater subsystem; and a modular unit docking connector coupled to the respective modular housing unit and coupled to each of the respective modular unit subsystems. The rack supports the plurality of prefabricated modular housing units. The rack includes: a rack electrical subsystem; a rack potable water subsystem; a rack wastewater subsystem; and a plurality of locations for supporting the plurality of modular housing units. Each of the plurality of locations including a respective rack docking connector coupled to the rack and coupled to each of the respective rack subsystems.

13 Claims, 32 Drawing Sheets

(51) Int. Cl.

| | |
|---|---|
| ***E04H 1/00*** | (2006.01) |
| ***E04B 1/343*** | (2006.01) |
| ***E04B 2/72*** | (2006.01) |
| ***E04B 5/48*** | (2006.01) |
| *E04H 1/12* | (2006.01) |
| *E04B 2/74* | (2006.01) |

(52) U.S. Cl.
CPC ..... *E04B 2/721* (2013.01); *E04B 5/48* (2013.01); *E04H 1/04* (2013.01); *E04B 2002/7488* (2013.01); *E04H 2001/1283* (2013.01)

(56) References Cited

U.S. PATENT DOCUMENTS 3,525,186 A * 8/1970 Lombardo ..... E04H 6/18 414/255
3,541,744 A * 11/1970 Maxwell ..... E04B 1/3404 52/73
3,613,321 A * 10/1971 Rohrer ..... E04B 1/34807 52/73
3,623,296 A * 11/1971 Santoro ..... E04B 1/34807 52/79.12
3,712,007 A * 1/1973 Kump ..... E04B 1/2403 52/648.1
3,721,056 A * 3/1973 Toan ..... E04B 1/20 52/236.6
3,755,974 A * 9/1973 Berman ..... E04B 1/34815 52/185
RE28,367 E * 3/1975 Rich, Jr. et al. .... E04B 1/34807 52/79.11
4,006,566 A * 2/1977 Forgiarini ..... E04H 1/02 52/220.2
4,372,087 A * 2/1983 Kump ..... E04B 1/34807 4/211
6,470,630 B1 * 10/2002 Miyamoto ..... E04B 1/34807 52/64
8,291,648 B1 * 10/2012 Orr ..... E04B 1/34305 135/124
2003/0101680 A1 * 6/2003 Lee ..... E04B 1/34807 52/745.2
2003/0136062 A1 * 7/2003 Gunthardt ..... B66C 23/20 52/120
2010/0180518 A1 * 7/2010 Postlethwaite ..... E04H 3/08 52/79.1
2012/0255240 A1 * 10/2012 Shen ..... E04B 1/34305 52/79.5
2014/0123574 A1 * 5/2014 Paone ..... E04H 1/005 52/79.12
2016/0083964 A1 * 3/2016 Martino ..... B65D 73/0014 52/489.1

FOREIGN PATENT DOCUMENTS

FR WO 2013128245 A1 * 9/2013 ..... E04B 1/34807
MC WO 2012123118 A1 * 9/2012 ..... B29C 44/1233

OTHER PUBLICATIONS

From Wikipedia, "Nakagin Capsule Tower," Jul. 2, 2015, https://en.wikipedia.org/wiki/Nakagin_Capsule_Tower, pp. 1-4.
Adele Peters, "This Texas Professor Is Turning a Dumpster Into the World's Ultimate Tiny Home," Jan. 26, 2014, pp. 1-4.
Alibaba.com, "Vertical Parking Garage, Vertical Parking Garage Suppliers and Manufacturers at Alibaba.com" downloaded Jul. 29, 2015 from http://www.alibaba.com/showroom/verticalparking-garage.html, pp. 1-13.
Arnout Visser, et al., "Studio Detail: Function Tiles", Droog, Retrieved from URL: http://studio.droog.com/studio/all/dry-bathing/function-tiles-by-amout-visser-erik-jan-kwakkel--peter-van-der-jagt/, 2016, p. 1.
Laboratoire Urbanisme Insurrectionnel, <http://laboratoireurbanismeinsurrectionnel.blogspot.fr/2012/10/architecture-mobile.html> website accessed Jul. 29, 2015 (31 pages).

* cited by examiner

2140

2120

MODULAR HOUSING UNITS, REUSABLE SUPPORT STRUCTURE, AND UTILITY CONNECTOR

This application claims priority to U.S. Provisional Application No. 62/218,975, filed Sep. 15, 2015, entitled "Modular Housing Units Supported by Reusable Support Structure and Coupled to Utilities Via Utility Connector", which is hereby incorporated by reference in its entirety. This application further claims benefit of priority of U.S. Provisional Application Ser. No. 62/150,363, filed Apr. 21, 2015, entitled "Stand-alone and combinable permanent housing shelters that are portable, modular, and stackable, and the methods of transport, connection, docking, vertical grid assembly, and deployment," which is hereby incorporated by reference in its entirety.

BACKGROUND

Housing, especially in urban areas, is subject to many conditions (e.g., rules, regulations, pre-existing infrastructure, etc.). Modular housing addresses some of these issues by spreading the upfront costs of compliance across numerous units. However, while modular housing may be constructed such that the living quarters comply with most rules and regulations across various jurisdictions, the underlying structure between the modular units and the land that the modular units are placed on may often require custom fabrication (e.g., based on the characteristics of the land or local rules and regulations).

Also, housing in urban areas is almost always somewhat permanent. Once a house or a condominium is built, it stays in place for decades, forcing those that come and go from the local area to pack and ship their things to another permanent building. The underlying structure and infrastructure for permanent buildings is often custom work, which makes the initial construction expensive and time consuming.

What is needed is a reusable structure that is designed to accept modular housing units and is designed to provide an underlying infrastructure between the modular housing units and the land on which the modular units reside and the utilities relied upon by the modular units.

Figure 1:
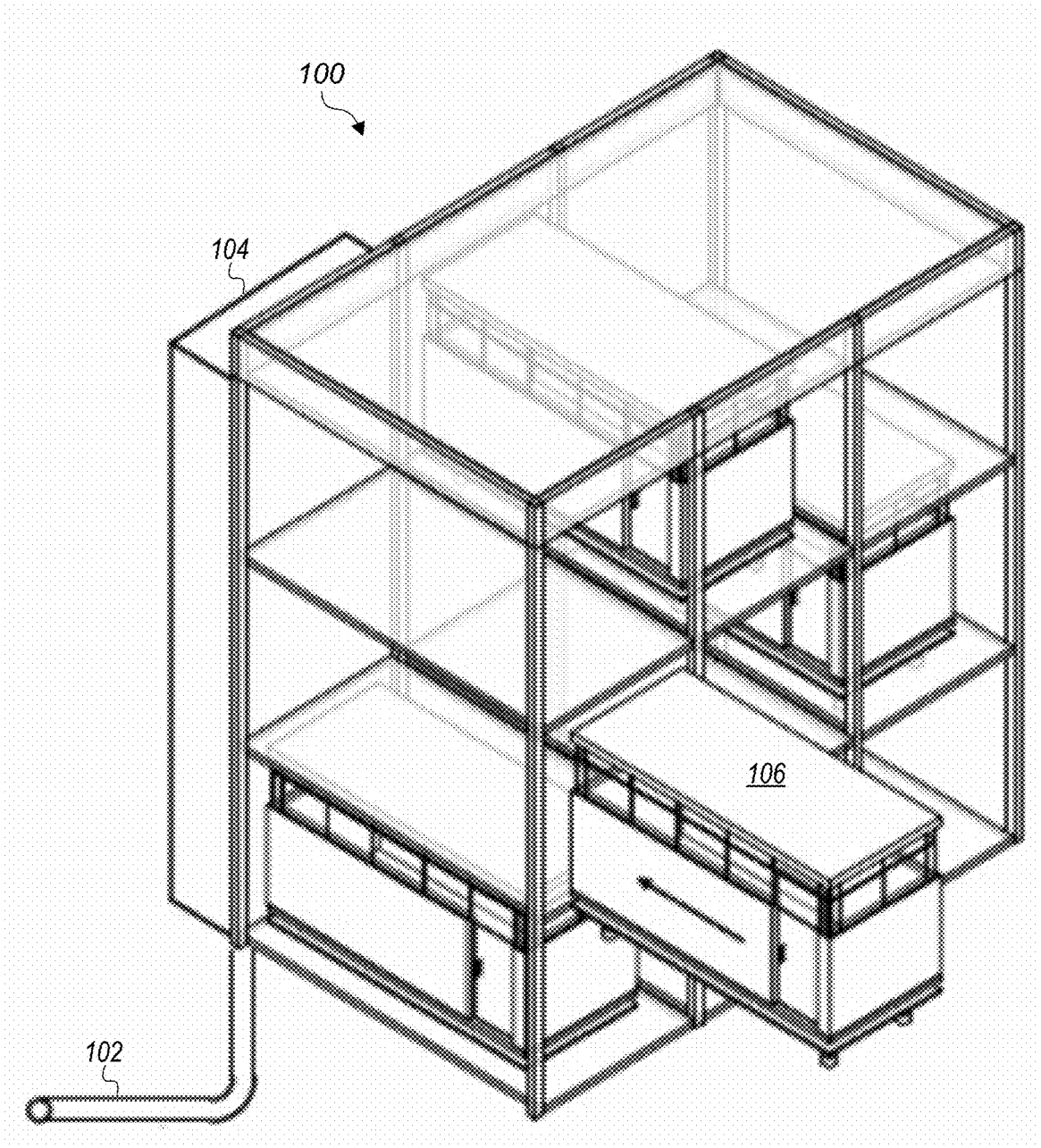
FIG. 1 illustrates a rack infrastructure for supporting and housing a number of insertable and removable modular housing units, according to some embodiments.

The various embodiments described herein are susceptible to various modifications and alternative forms. Specific embodiments are shown by way of example in the drawings and will herein be described in detail. It should be understood, however, that the drawings and detailed description thereto are not intended to limit the disclosure to the particular form disclosed, but on the contrary, the intention is to cover all modifications, equivalents and alternatives falling within the spirit and scope of the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION OF EMBODIMENTS

Devices, systems and processes for modular housing units are disclosed. In embodiments, the modular housing units are supported by a support structure (e.g., a reusable support structure that may be configured to facilitate disassembly and reassembly). The devices, systems and processes include various features in various arrangements and/or configurations. For example, the modular housing units may be placed into an assembled rack and coupled to utilities via a particularly-configured utility connector.

Generally, the devices, systems and processes may be designed as a modular system. For example, the racks may be built with materials that are designed to be configured in a number of ways. In some embodiments, the racks may be built from posts and beams with connectors that provide for variously-configured racks. For example, a rack may be built from posts and beams such that the rack receives and supports modular housing units stacked upright (e.g., 2 high and 4 wide). In another example, the same posts and beams and connectors may be used in another configuration that supports modular housing units stacked upright (e.g., 3 high and 6 wide). Although the number in the stack height and/or stack width may be any number, the posts and beams are designed to be used (e.g., disassembled and reassembled) in any of various configurations.

FIG. 1 illustrates a rack infrastructure for supporting and housing a number of insertable and removable modular housing units, according to some embodiments. In the illustrated embodiment, rack assembly 100 (or "rack") is depicted in a 3×3 configuration such that the rack 100 supports modular housing units stacked three high and three wide. Other heights and widths are contemplated, with FIG. 1 being an illustrative example. Racks (e.g., the racks in FIGS. 1-4, 7, 10-12, 15-17) may be assembled and/or disassembled in a manner similar to the processes illustrated in FIG. 28, described below.

In the illustrated embodiment, rack 100 is already supporting three modular housing units and a fourth modular housing unit 106 is being positioned into the rack 100. Rack 100 is illustrated with drainage system 102 and stairwell or elevator system 104. The drainage system may include a roof assembly that covers the rack and is configured to orient collected rain into a drainpipe that orients the collected rainwater out and away from the rack assembly. The stairwell and/or elevator system 104 may be configured to provide access to one or more of the levels of the rack assembly.

Figure 2B:
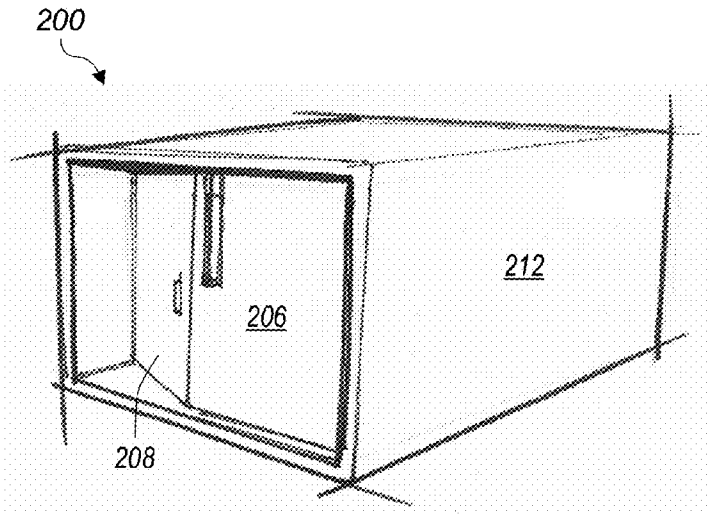
FIGS. 2A-B illustrate a number of alternative designs for modular, stackable housing, according to some embodiments.
Figure 2A:
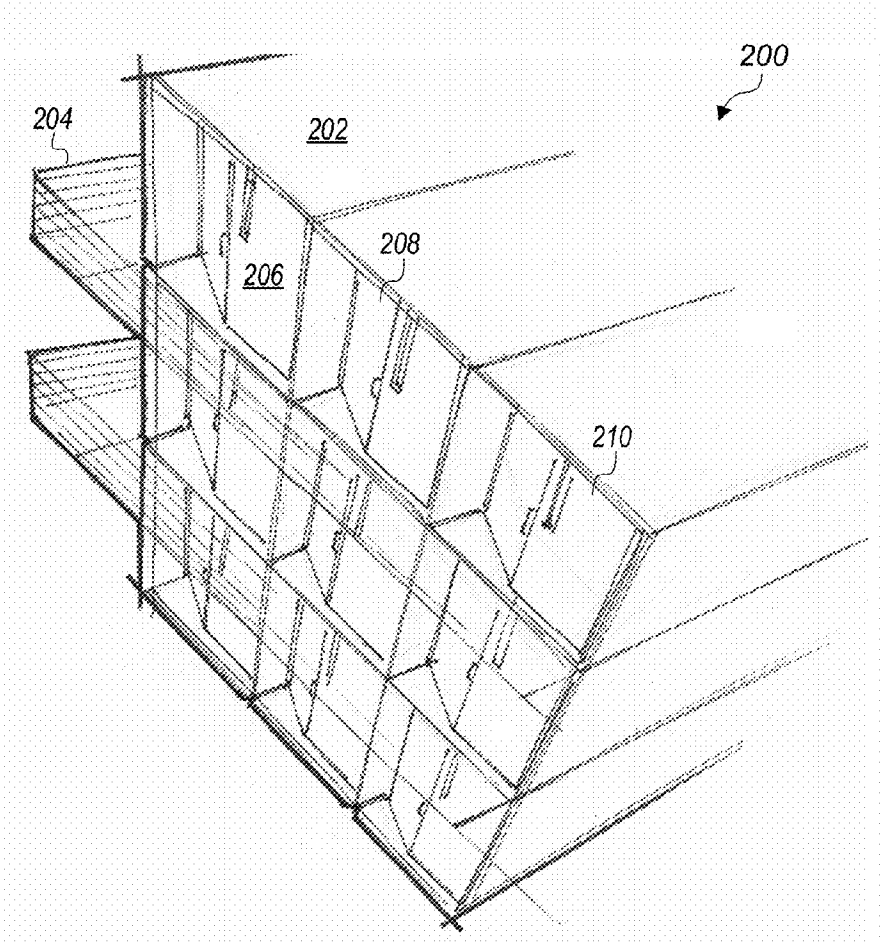

FIGS. 2A-B illustrate a number of alternative designs for modular, stackable housing, according to some embodiments. FIG. 2A illustrates modular housing units (e.g., a 3×3 stack of individual units, such as individual unit 206) with a walkway and railing access system 204 as part of an overall multi-unit dwelling 200. In some embodiments, the illustrated embodiment depicts modular housing units stacked on top of one another (e.g., without a rack—the individual units are placed on one-another and are each individually configured to support the weight of the other units that are stacked on them). In other embodiments, the illustrated embodiment depicts a modular structure made of slabs (e.g., preformed concrete slabs 202 that are built into a framework or rack) in which the individual modular housing units are placed, such that the concrete slab framework supports the individual units in the stack. FIG. 2A illustrates that the front of one or more of the units may be configured with a door (e.g., door 208) set at an angle so as to provide a landing in front of the door. The front of one or more of the units may be configured with a wall 210 next to the door 208. The wall 210 may include a vertical window, in embodiments.

FIG. 2B illustrates a modular housing unit, in embodiments. The modular housing unit 206 is depicted with angled door and landing (collectively a door and landing assembly 208) and front wall 210 with window slit. The modular housing unit is illustrated with outside wall 212. The construction materials may vary across embodiments (e.g., concrete, steel, fiberglass, etc.).

Figure 3B:
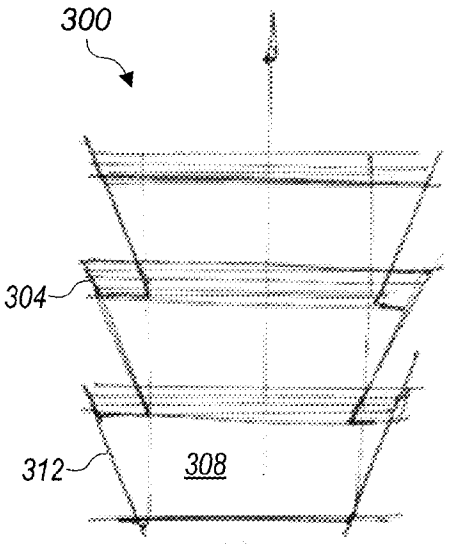
FIGS. 3A-B illustrate a number of alternative designs for modular, stackable housing, according to some embodiments.
Figure 3A:
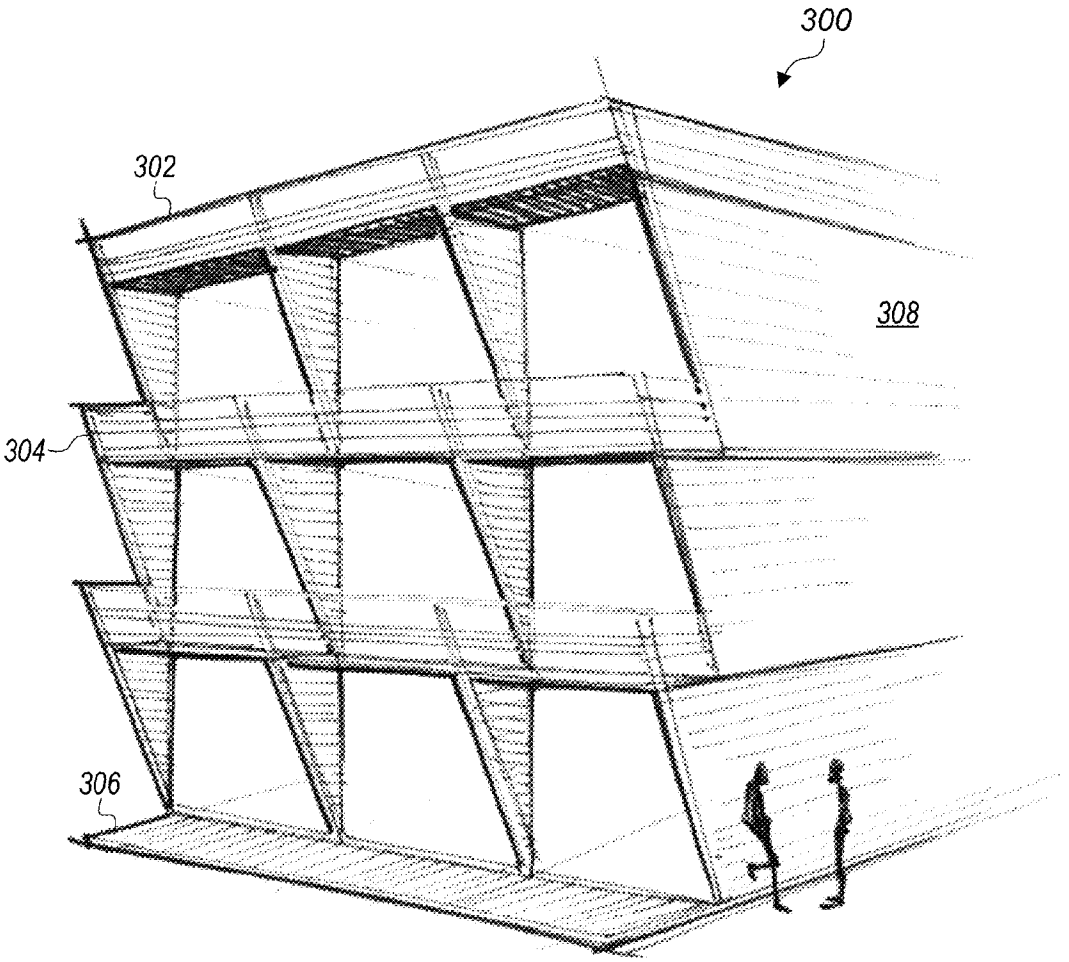

FIGS. 3A-B illustrate a number of alternative designs for modular, stackable housing, according to some embodiments. Multi-unit structure 300 is depicted with a first-level walkway 306, railing/balcony assembly 304 and roof-top patio and railing assembly 302. In the depicted embodiment, the walls (e.g., 308) may be configured with the ends at an angle such that the roof line for each modular housing unit provides an overhang (e.g., protection against sun and rain) for each individual unit (e.g., individual unit 308). In the depicted embodiment, the wall may be part of a rack structure that the individual housing units are supported by, or may be part of each actual modular housing unit (e.g., where the modular units are stacked on one-another, instead of being supported by a rack). FIG. 3B illustrates a side view of the multi-unit housing structure 300 with railing/balcony assembly 304, and individual-unit overhang 312. In the depicted embodiment, both ends of the modular housing units or rack (depending on the embodiment) may be configured with the angular overhang features.

Figure 4C:
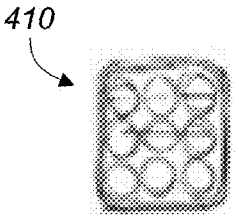
FIGS. 4A-F illustrate a number of alternative designs for modular, stackable housing, according to some embodiments.
Figure 4B:
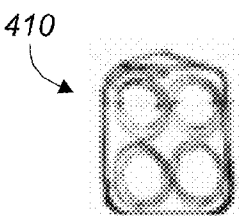
Figure 4E:
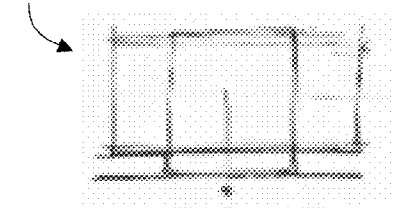
Figure 4D:
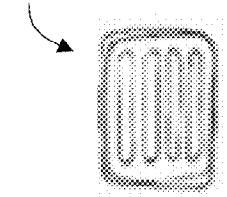
Figure 4F:
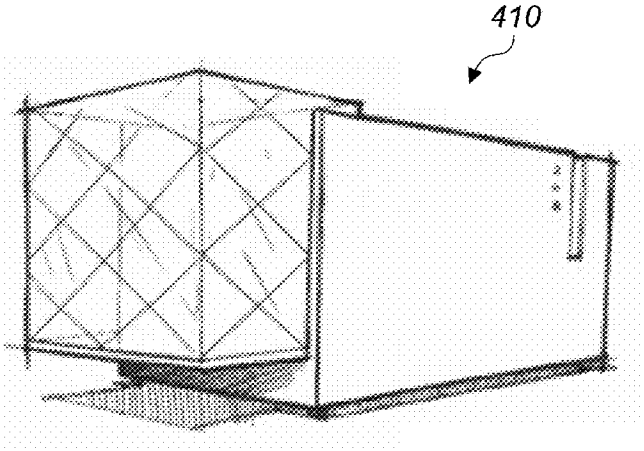
Figure 4A:
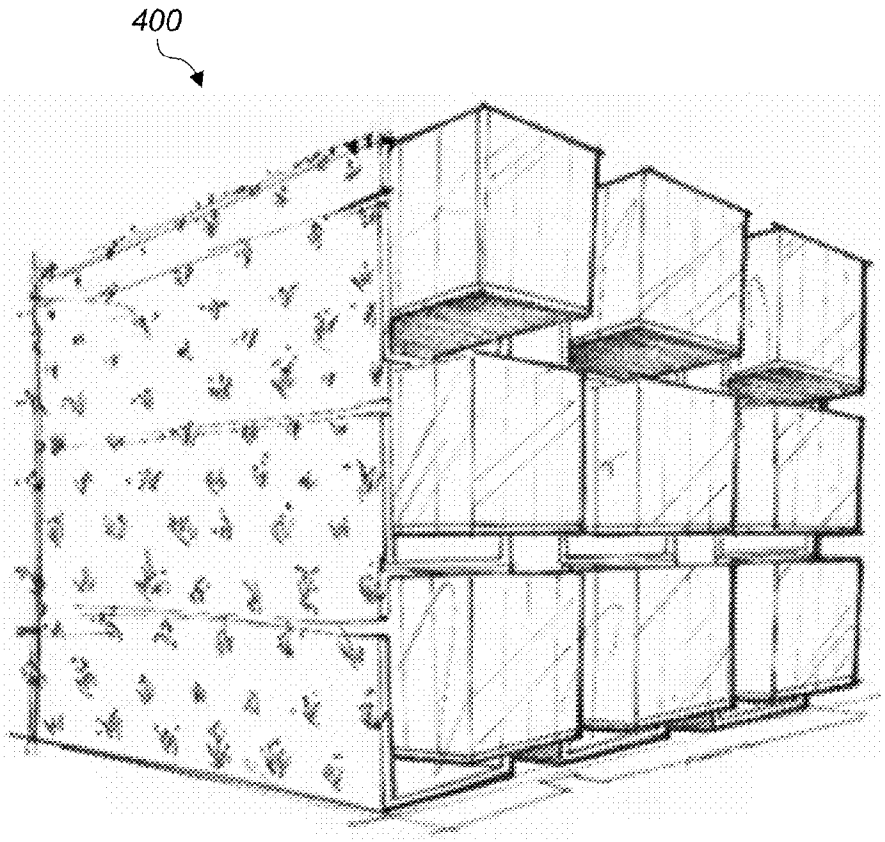
Figure 4G:
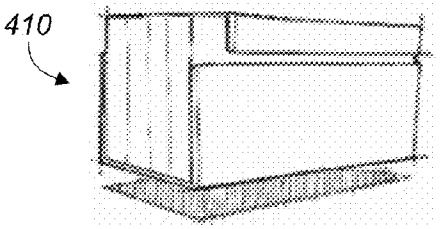
FIGS. 4G-O illustrate a number of alternative designs for modular, stackable housing, according to some embodiments.
Figure 4H:
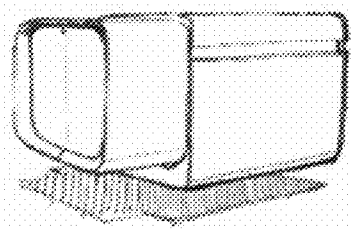
Figure 4I:
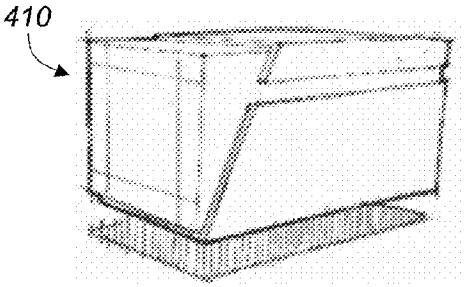
Figure 4J:
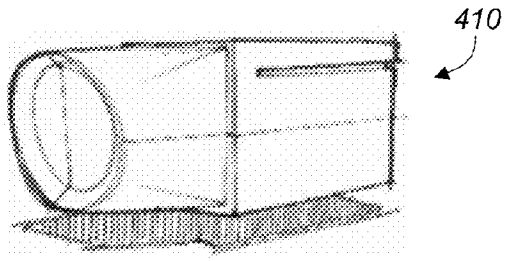
Figure 4K:
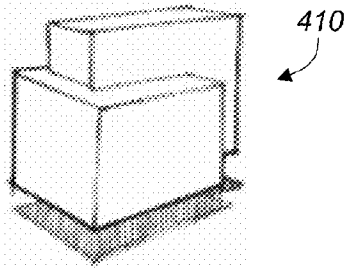
Figure 4L:
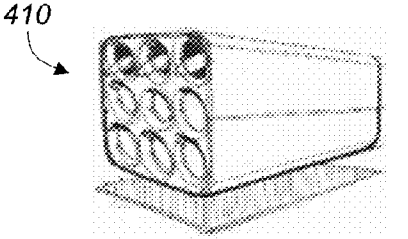
Figure 4M:
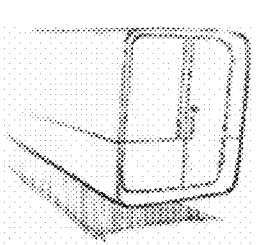
Figure 4N:
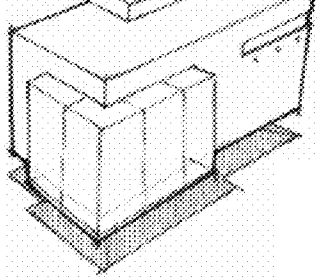
Figure 4O:
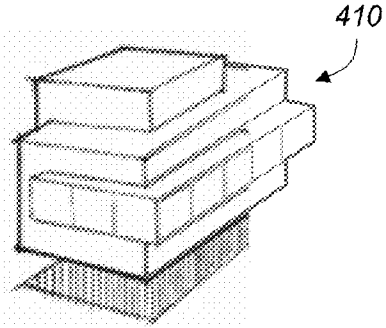

FIGS. 4A-F illustrate a number of alternative designs for modular, stackable housing, according to some embodiments. FIG. 4*a* illustrates a 3×3 multi-unit structure 400 with individual units that have a glass structure on the end of the unit. The multi-unit structure 400 is also depicted with foliage on the side-wall of the rack (or individual units, depending on the embodiment). FIGS. 4B, 4C, 4D and 4E illustrate other arrangements and geometrical shapes that depict other configurations. FIG. 4B illustrates a 2×2 configuration with round modular units, FIG. 4C illustrates a 3×3 configuration with rounds modular housing units, FIG. 4D illustrates a 4×1 configuration with individual modular units that are tall and side-by-side, instead of stacked on top of one another. In some embodiments, each individual modular unit may be a two story unit and the two story units may be stacked on top of one another or stacked in a rack such that one two-story unit is above another two-story unit. In some embodiments a rack may be configured to support both single-story and two-story units (e.g., some receiving areas [areas that receive a modular unit and support the unit] of the rack may be taller for the two-story modular units and other receiving areas may be short for the single-story modular units. Modular units and the racks that support them may configured in various other combinations (e.g., three story units, racks that are configured with receiving areas or locations that can accommodate various size modular housing units). FIG. 4E illustrates a multi-unit facility 408 with various-sized units, for example. FIG. 4F illustrates a modular housing unit 410 with a raised glass area on one end and a slot glass window on the side.

FIGS. 4G-O illustrate a number of alternative designs for modular, stackable housing, according to some embodiments.

Figure 5A:
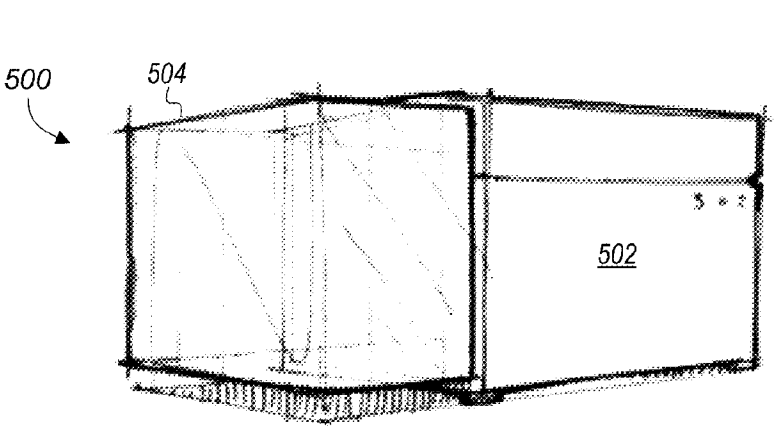
FIGS. 5A-D illustrate a number of alternative designs for modular, stackable housing, according to some embodiments.
Figure 5B:
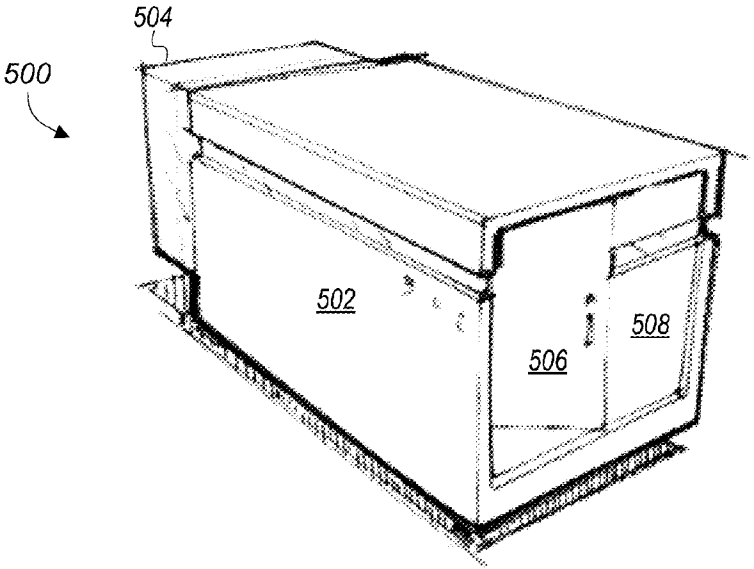
Figure 5C:
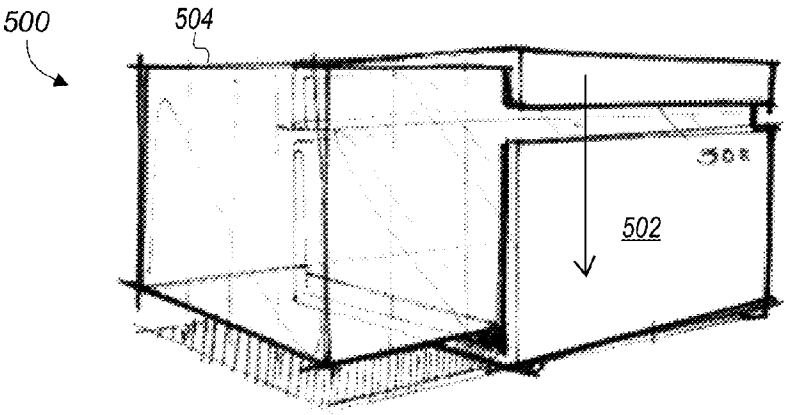
Figure 5D:
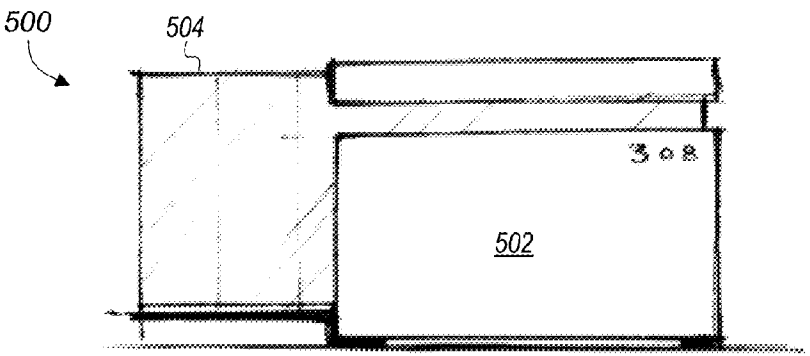

FIGS. 5A-D illustrate a number of alternative designs for modular, stackable housing, according to some embodiments. In the illustrated embodiments, unit 500 is depicted with a glass end 504 and wall 502. FIG. 5B illustrates a slanted or angled door 506 that provides for a landing in front of the door. The door 506 closes against end wall 508 that has a slot window. FIG. 5C illustrates that the modular unit 500 may be configured with a roof that lowers down onto wall 502.

Figure 5E:
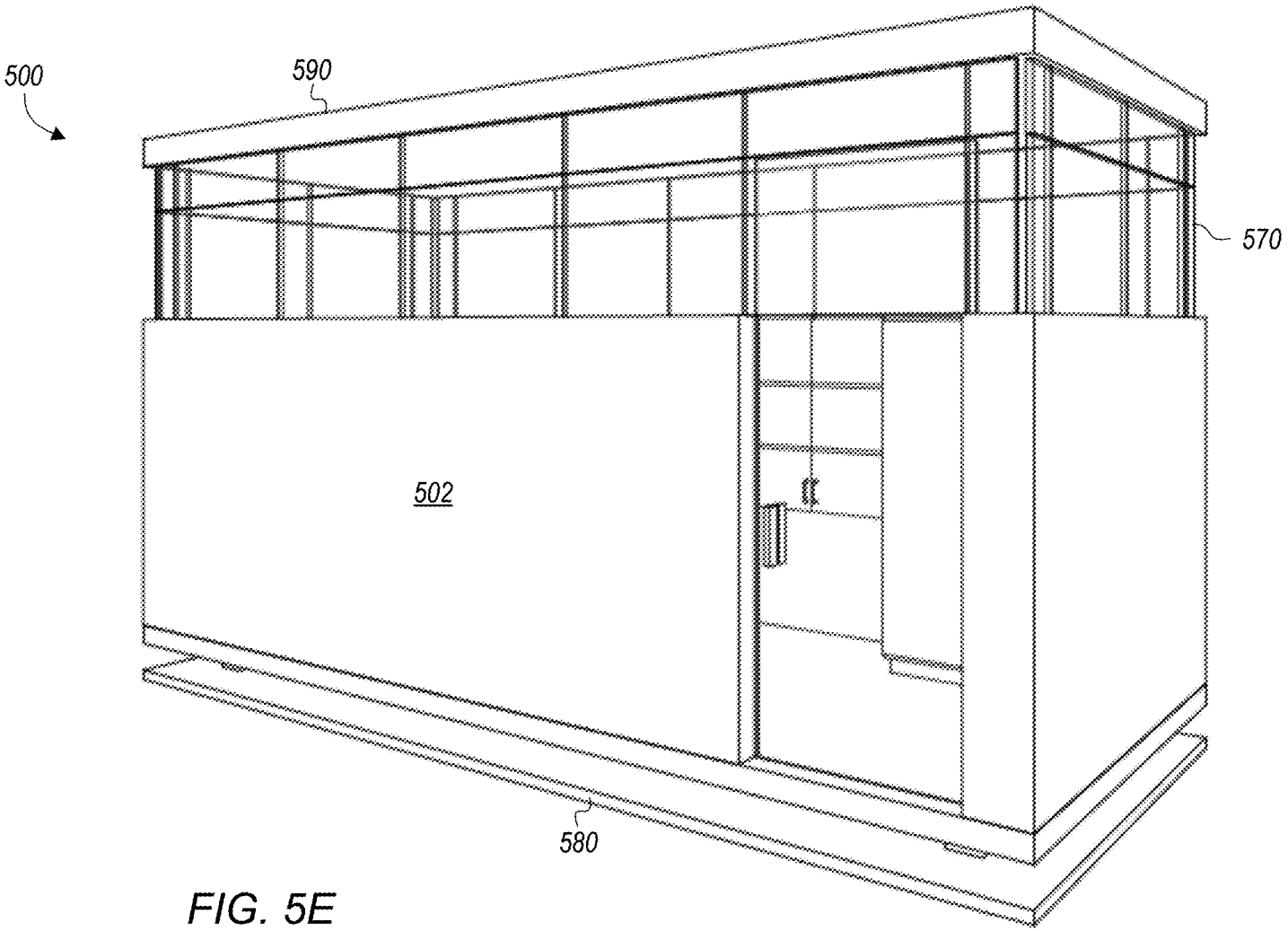
FIG. 5E is a perspective view of a modular, stackable housing unit with a raisable/lowerable roof, according to some embodiments.

FIG. 5E is a perspective view of a modular, stackable housing unit with a raisable/lowerable roof, according to some embodiments. In the depicted embodiment, unit 500 includes adjustable roof 590, wall 502, double-panel foundation 580 and glass area 570. In the illustrated embodiment, the door is on the side of the unit and the roof 590 may be raised and lowered along with the glass surround 570. For example, a hydraulic system may raise and lower a steel and glass framework. In some embodiments, the roof and glass surround may be lowered such that the modular housing unit fits into a shipping container (e.g., FIGS. 7F and 7G).

Figure 6A:
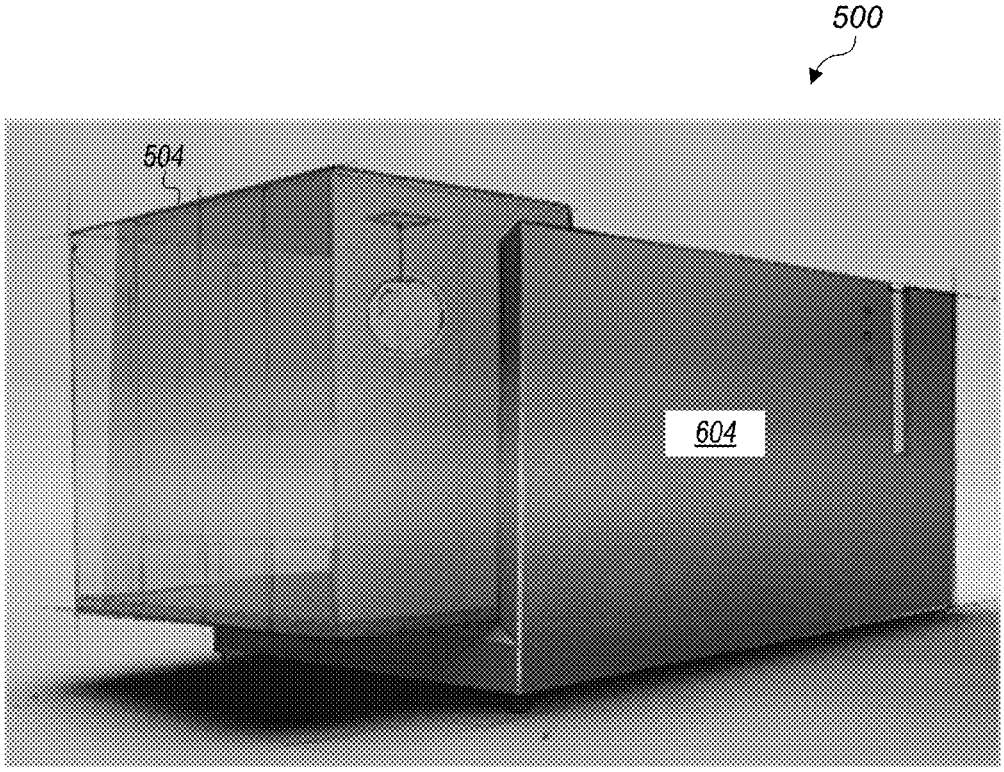
FIGS. 6A/B provide a perspective view of a modular, stackable housing unit with a glass enclosure on one end and an entryway on the other end, according to some embodiments.
Figure 6B:
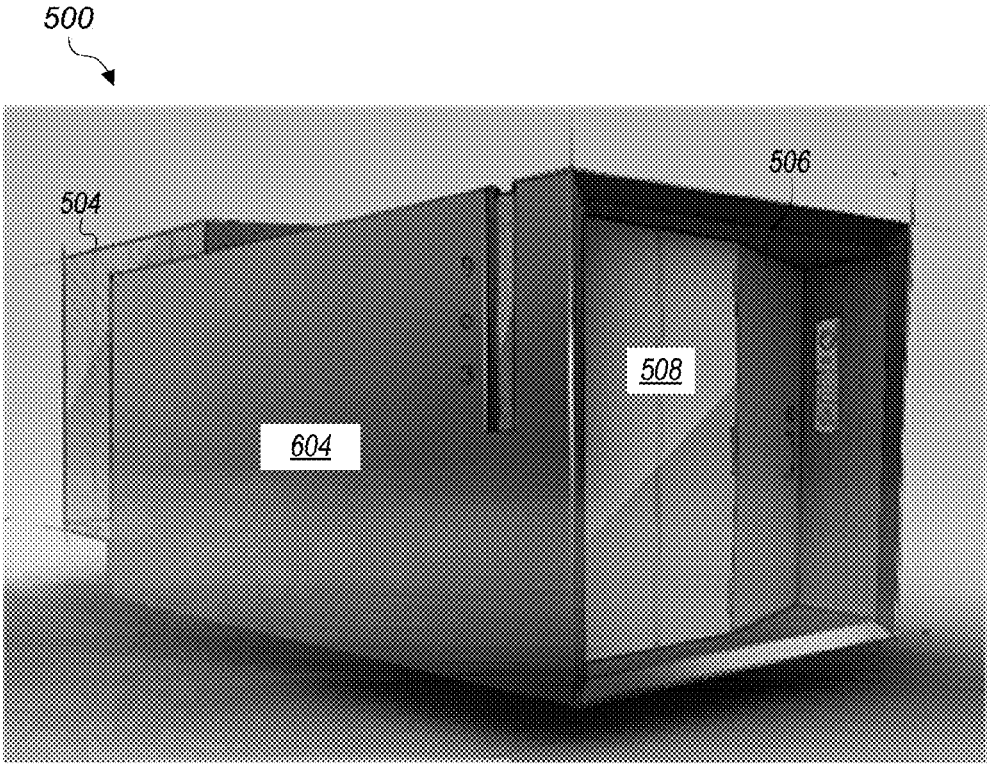

FIGS. 6A & B provide a perspective view of a modular, stackable housing unit with a glass enclosure on one end and an entryway on the other end, according to some embodiments. Glass enclosure 504 is illustrated as a raised, cantilevered glass-surround area on one end of modular housing unit 500. Exterior wall 604 is illustrated with a glass window slit. FIG. 6B illustrates the other end of the unit 500 and depicts the door 508 that is set at an angle to provide a landing area in front of the door and a front exterior wall 506.

Figure 7A:
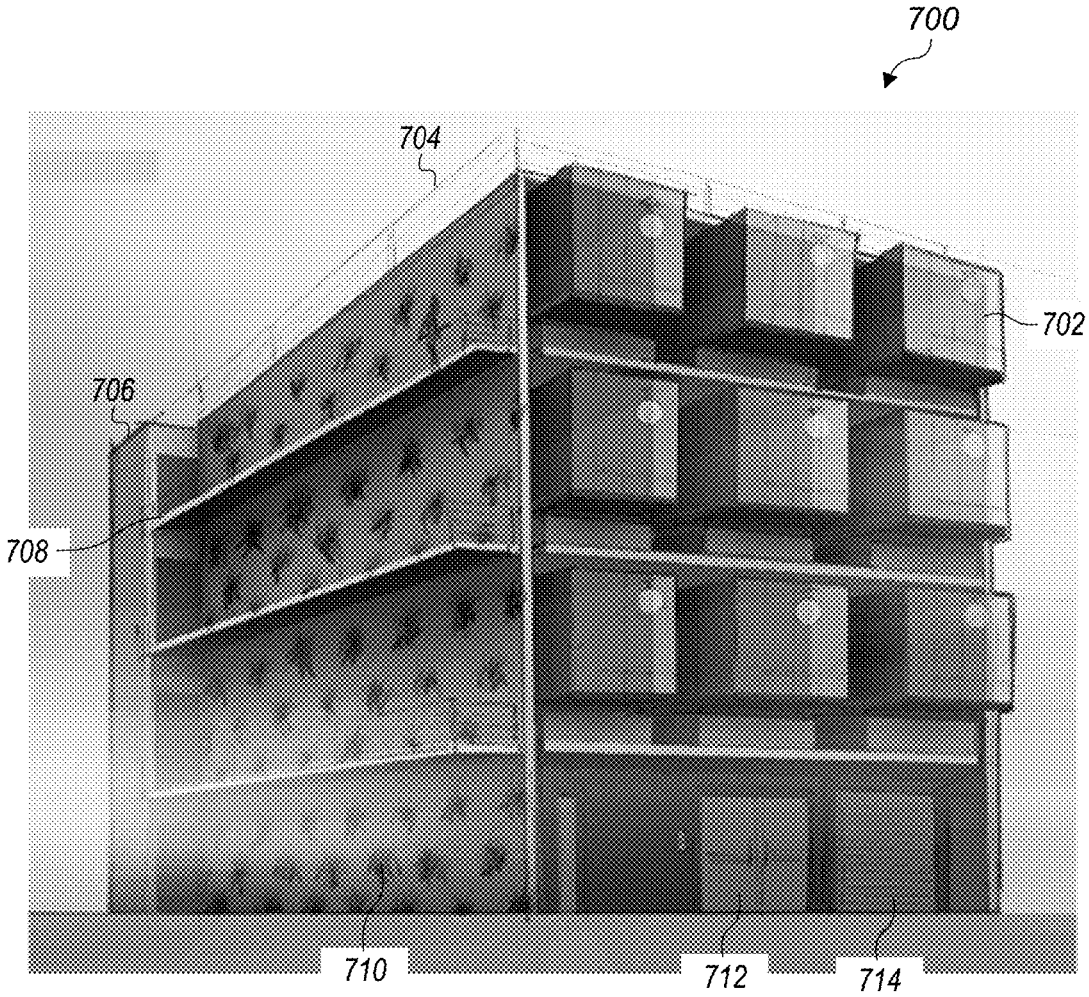
FIG. 7A illustrates a structure for stacking a number of modular, stackable housing units, according to some embodiments.
Figure 7B:
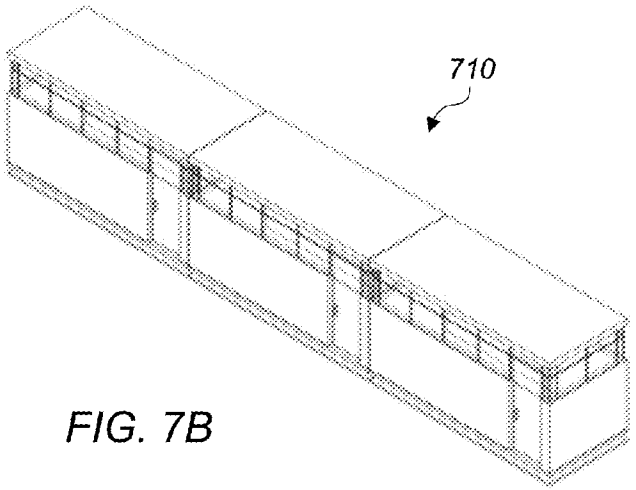
FIGS. 7B-E illustrate a number of ways of arranging a number of modular, stackable housing units, according to some embodiments.

FIG. 7A illustrates a structure for stacking a number of modular, stackable housing units, according to some embodiments. In the illustrated embodiment, the multi-unit housing system 700 is illustrated with a rack 708 that includes a railing for a rooftop gathering area 704, decorative foliage wall cladding 710, and a stairwell 706, nine individual modular units, each with a cantilevered glass end 702, and modular storage 712 and/or parking units 714. In some embodiments, the rack may be formed from an arrangement of precast concrete slabs, steel framework, or any of numerous construction materials. In the illustrated embodiment, the stairwell 706 opens out a number of doors for each floor onto a walkway along the outside decorative wall that provides access to the various units.

Figure 7C:
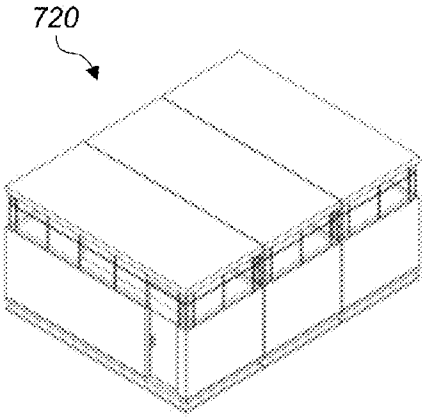
Figure 7D:
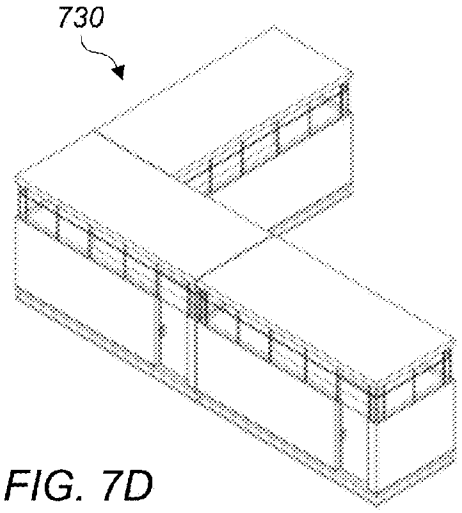
Figure 7E:
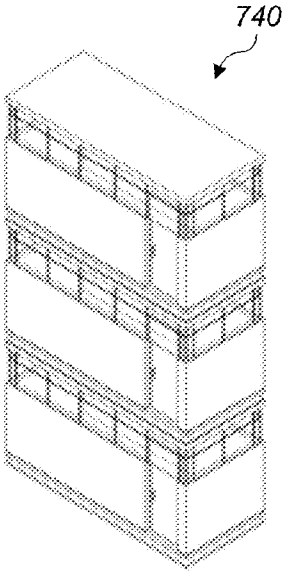

FIGS. 7B-E illustrate a number of ways of arranging a number of modular, stackable housing units, according to some embodiments. 7B illustrates 3 units that are arranged end-to-end as a multi-unit group 710. FIG. 7C illustrates three units that are arranged side-by-side as a multi-unit group 720. FIG. 7D illustrates three units that are arranged in a combination of end-to-end and end to side as a multi-unit group 730. FIG. 7E illustrates a stack of three units as a multi-unit group 740. The examples are illustrative, not restrictive and other embodiments may change the number of units or change how the individual units are oriented with respect to one-another.

Figure 7G:
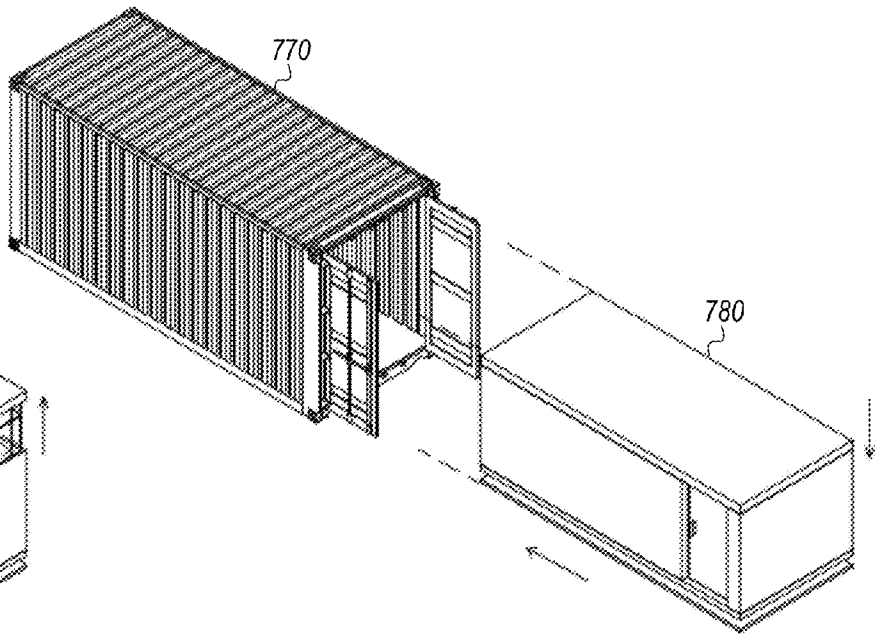
FIGS. 7F/G illustrates a modular, stackable housing unit that fits in a shipping container, according to some embodiments.
Figure 7F:
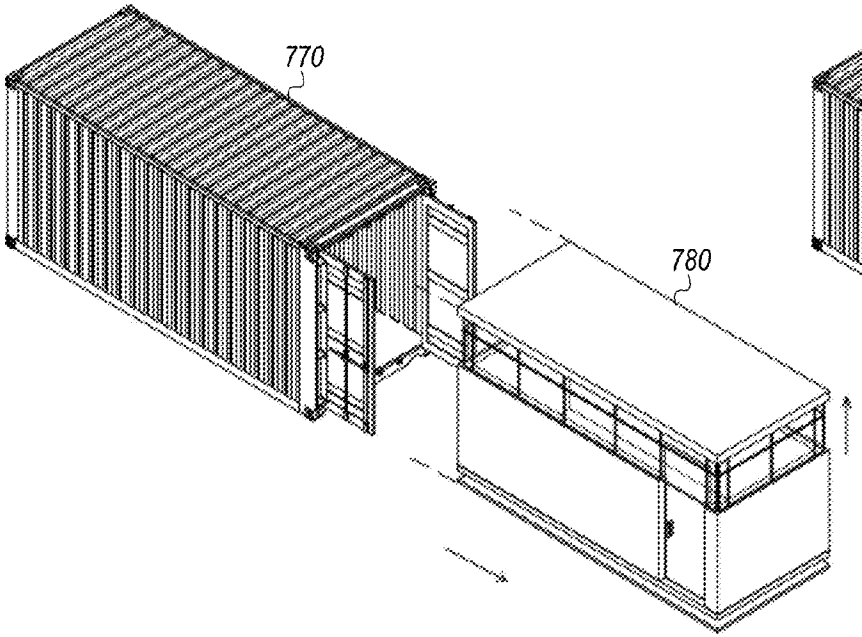

FIGS. 7F/G illustrates a modular, stackable housing unit that fits in a shipping container, according to some embodiments. FIG. 7F illustrates a modular housing unit 780 that is configured to fit into a shipping container 770 (e.g., for intermodal shipments). In the illustrated embodiment, the modular housing unit 780 is has been removed from the shipping container 770 and the roof of the modular housing unit has been raised. FIG. 7G illustrates that the modular housing unit roof has been collapsed or lowered such that the modular housing unit 780 can be placed into the shipping container.

Figure 8:
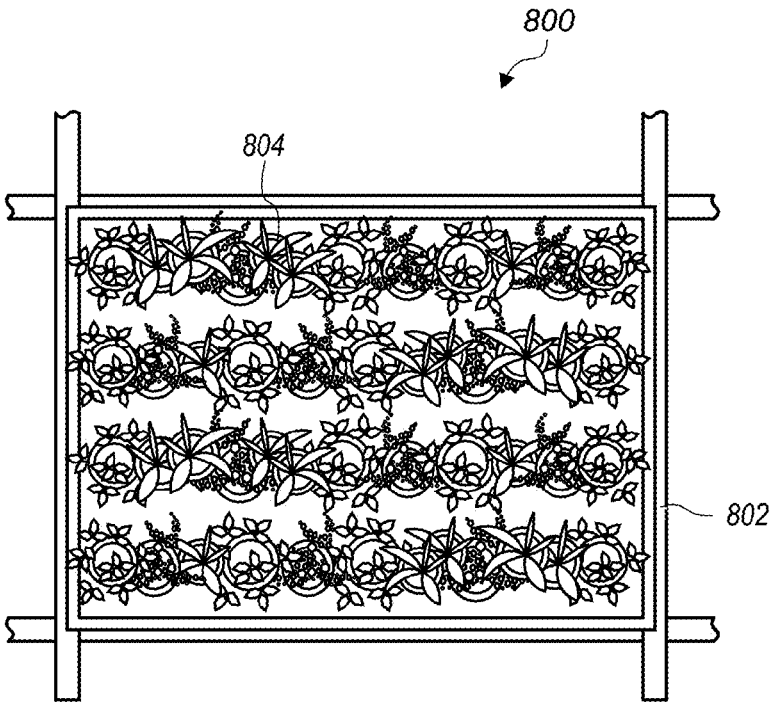
FIG. 8 illustrates cladding for the exterior of a rack or modular, stackable housing unit, according to embodiments.

FIG. 8 illustrates cladding for the exterior of a rack or modular, stackable housing unit, according to embodiments. In embodiments, the rack (or the individual modular housing units) may be configured with any of various cladding. For example, the exterior wall of a rack unit 802 may be configured with foliage-type cladding 804. Other types of cladding are also contemplated such as advertising cladding (e.g., cladding configured as a billboard), sound-reduction cladding, cladding that is configured to blend in with the surroundings of the rack (camouflage cladding), etc.

Figure 9:
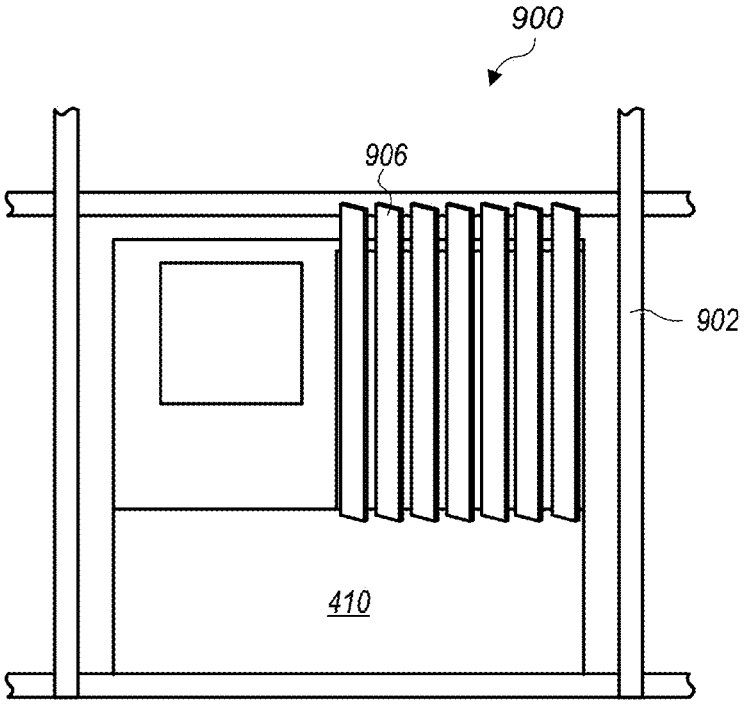
FIG. 9 illustrates blinds for a rack or modular, stackable housing unit, according to embodiments.

FIG. 9 illustrates blinds for a rack or modular, stackable housing unit, according to embodiments. In embodiments, blinds or other mechanisms for providing protection from the exterior elements (e.g., sun, rain, snow, etc.) may be part of the rack system. For example, rack 902 may be configured with blinds 906 (e.g., adjustable blinds).

Figure 10:
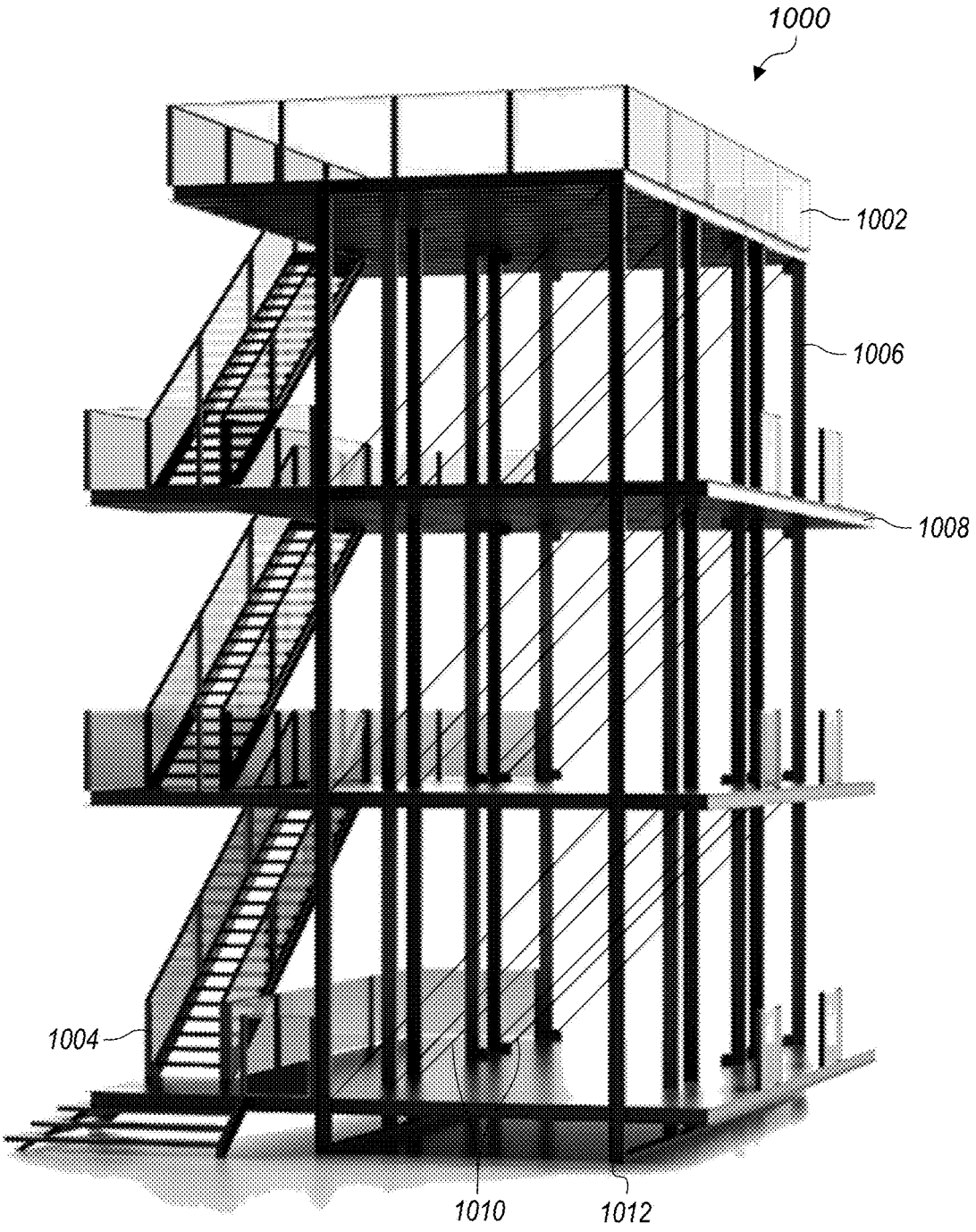
FIG. 10 illustrates a metal rack for supporting a number of modular, stackable housing units, according to some embodiments.

FIG. 10 illustrates a metal rack for supporting nine modular, stackable housing units, according to some embodiments. In the illustrated embodiment, rack 1000 is depicted with four levels (e.g., 1008 is the third level) supported by posts (e.g., metal post 1006). The levels are connected via staircase 1004. The levels are also connected by supportive guidewires 1010 that triangulate the structure and provide add strength and stability, in embodiments. The top of the rack structure may be configured as rooftop gathering area with railing 1002. In the illustrated embodiment, the railing may be configured with removable and replaceable sections such that the railing can be removed for placement of an individual modular unit in one of the nine available locations and then readily replaced after the modular unit has been placed in the rack.

In some embodiments the rack may be configured such that the rack can be disassembled and reassembled (e.g., without welding or torching). For example, when the rack is made from a post and/or beam structure, the post and beams may be coupled via bolts that can be unbolted and/or via other mechanisms such as braces or collars or gravity connections or moment connections or trapeze assemblies or pipe shoes that provide for ready disassembly and reassembly.

In some embodiments, a system for bearing modular housing units comprises a structure comprising: a prefabricated structural framework, wherein the prefabricated structural framework is configured to receive and support a plurality of modular housing units, the prefabricated structural framework including: a plurality of prefabricated vertical frame columns; and a plurality of prefabricated horizontal frame beams, wherein each of the plurality of horizontal frame beams are coupled to at least two vertical frame columns via a releasable coupling mechanism, and wherein the releasable coupling mechanisms between the prefabricated vertical frame columns and the prefabricated horizontal frame beams releasably couple the columns and beams.

In some embodiments, the system further comprises a prefabricated services subsystem including: electric cables for providing electric power to the modular housing units; tubular piping for providing water to the modular housing units; disposal piping for disposing materials from the modular housing units; and a coupler for coupling each respective one of the plurality of housing units to the prefabricated services subsystem, wherein each coupler comprises a set of connectors for each of the electric power, providing water, and disposing materials.

In some embodiments, the system further comprises environmental cladding, wherein the environmental cladding is coupled to the prefabricated structural framework as a non-loadbearing layer outside at least some of the plurality of modular housing units.

In some embodiments, the system further comprises a roof coupled to the framework, the roof comprising a plurality of prefabricated shells; and a rainwater collection and dispersion mechanism.

In some embodiments, the system further comprises a plurality of diagonal tie structures that each tie one of the releasable coupling mechanisms to another releasable coupling mechanism such that the diagonal tie structure forms a diagonal structural member between one of the vertical columns and one of the horizontal beams.

Another example, includes a load bearing structure for supporting a plurality of prefabricated units, the load bearing structure comprising: a frame including a plurality of members, wherein the members include a releasable coupling mechanism for coupling the members together, wherein the releasable couplers provide for coupling and decoupling the members of the frame such that the frame can be repeatedly erected, dismantled and re-erected; wherein the frame is configured to receive and support a plurality of modular housing units.

In some embodiments, the load bearing structure for supporting a plurality of prefabricated units further comprises an anchor system coupled to the steel frame, wherein the anchor system comprises a plurality of anchors that positively locate the steel frame to the ground.

In some embodiments, the load bearing structure for supporting a plurality of prefabricated units further comprises a plurality of unit housings for the plurality of prefabricated units, each unit housing configured to receive and support a prefabricated unit within the load bearing structure.

In embodiments, a method of erecting and disassembling a multi-unit prefabricated structure, comprises erecting the multi-unit prefabricated structure at a first location, erecting including: erecting a prefabricated structural framework, wherein the prefabricated structural framework is configured to receive and support a plurality of modular housing units, and wherein the prefabricated structural framework includes releasable coupling mechanisms between members of the structural framework; and placing a plurality of modular housing units into the erected prefabricated structural framework; disassembling the multi-unit prefabricated structure, disassembling including: removing the plurality of modular housing units from the erected prefabricated structural framework; and disassembling the prefabricated structural framework; and erecting the same multi-unit prefabricated structure using the same prefabricated structural framework at another location; wherein the releasable coupling mechanisms between members of the structural framework provide for repeated erection and disassembly of the same multi-unit prefabricated structure using the same prefabricated structural framework.

In some embodiments said erecting the prefabricated structural framework further comprises locking the plurality of modular housing units into the erected prefabricated structural framework; and wherein said disassembling the multi-unit prefabricated structure further comprises unlocking the plurality of modular housing units from the erected prefabricated structural framework.

In some embodiments said erecting the prefabricated structural framework further comprises coupling each the plurality of modular housing units to a respective services coupler, wherein each respective service coupler comprises a set of connectors for each of the electric power, providing water, and disposing materials; and wherein said disassembling the multi-unit prefabricated structure further comprises de-coupling each the plurality of modular housing units from the respective services coupler.

Figure 11:
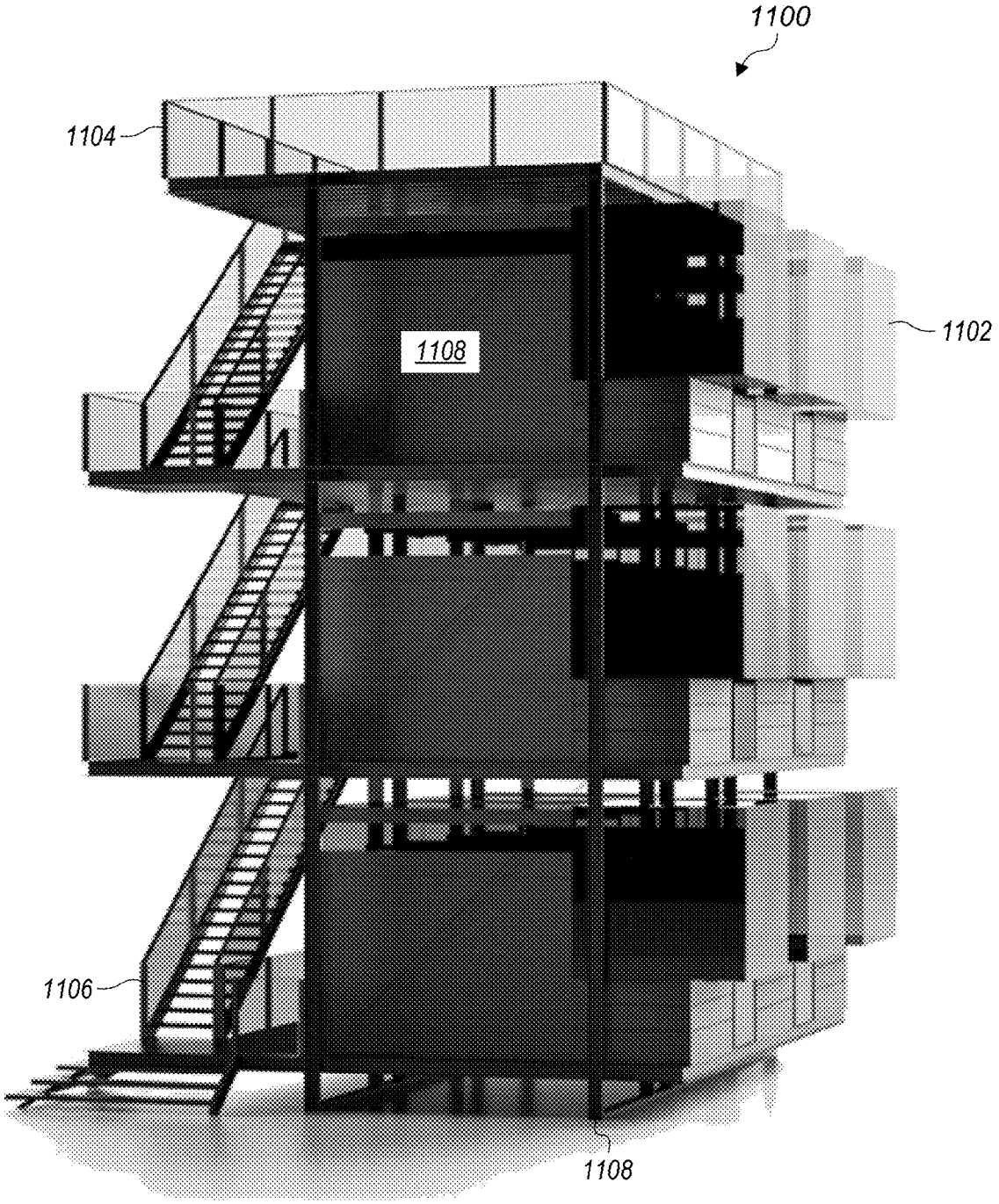
FIG. 11 illustrates a metal rack for supporting a number of modular, stackable housing units, according to some embodiments.

FIG. 11 illustrates a metal rack supporting a number of modular, stackable housing units (e.g., modular housing unit 1108 with cantilevered glass surround 1102 is one example unit), according to some embodiments. In some embodiments modular housing unit 1108 may include features similar to modular housing unit 410, described herein. In the illustrated embodiment, the rack is illustrated with nine modular housing units that have been placed into, and are supported by, the rack. The modular housing system 1100 is illustrated with a series of stairs (e.g., stairs 1106 may be similar to stairs 1004, in embodiments) that provide access to each level of the stack. In some embodiments, the stairs may be coupled to the rack to provide triangulation support to the rack structure. The rack is illustrated with a rooftop system that includes a railing 1104, in embodiments.

Figure 12:
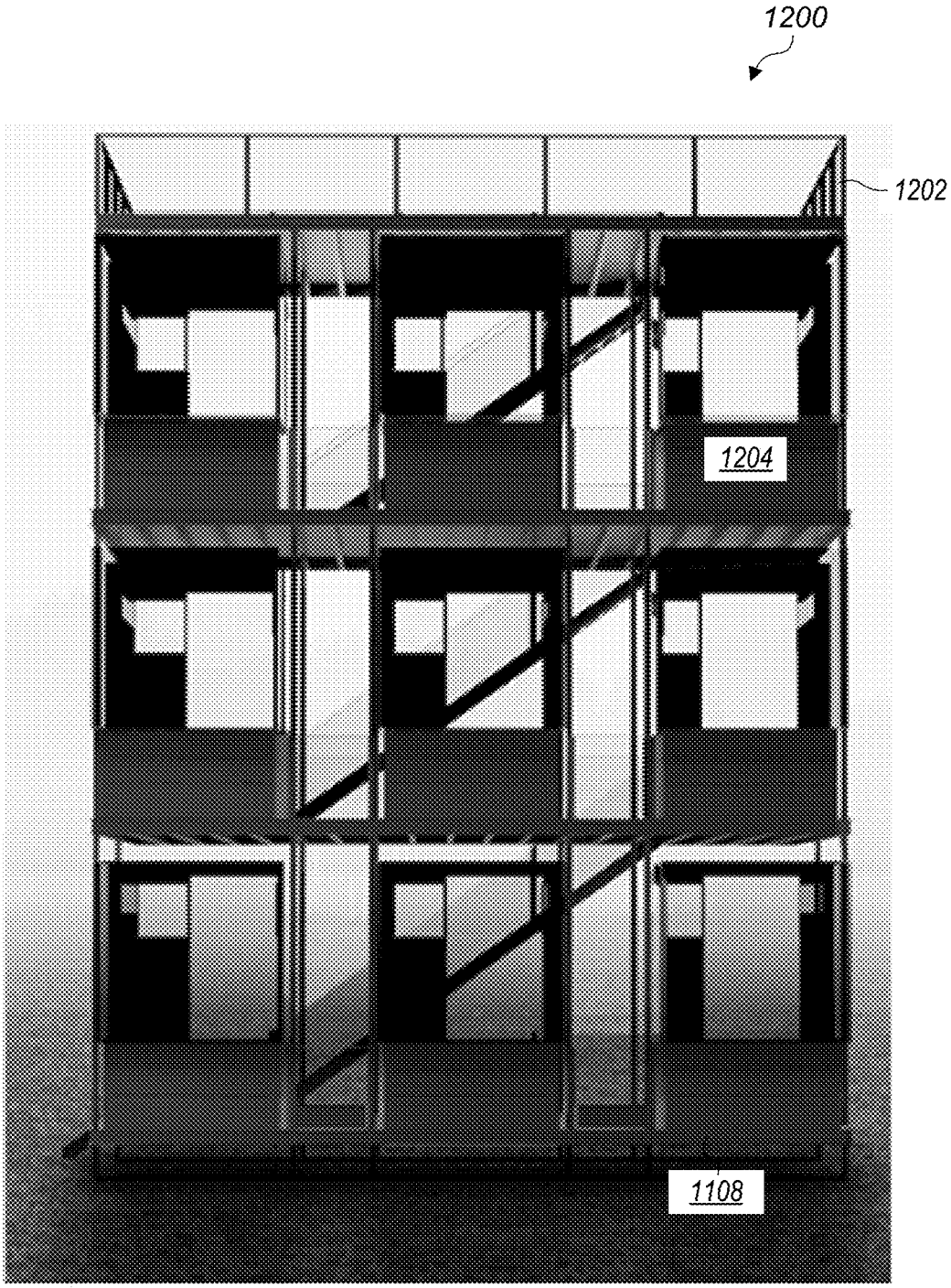
FIG. 12 illustrates a metal rack for supporting a number of modular, stackable housing units, according to some embodiments.

FIG. 12 illustrates a system 1200 that includes a metal rack supporting a number of modular, stackable housing units 410, according to some embodiments. In FIG. 12, the staircase 1202 is depicted as providing access to each level. In some embodiments, the staircase 1202 may be configured to provide additional triangulation stability and/or support (e.g., in addition to or in place of the triangulation guidewires depicted in FIG. 10. In some embodiments, the rack system and/or the modular housing units may be configured such that the space between units is set according to government code. For example, the space between units may be set to be no less than a specification of the international building code (e.g., IBC 2015). Other building codes may be specified (local, state, federal, etc.).

Figure 13:
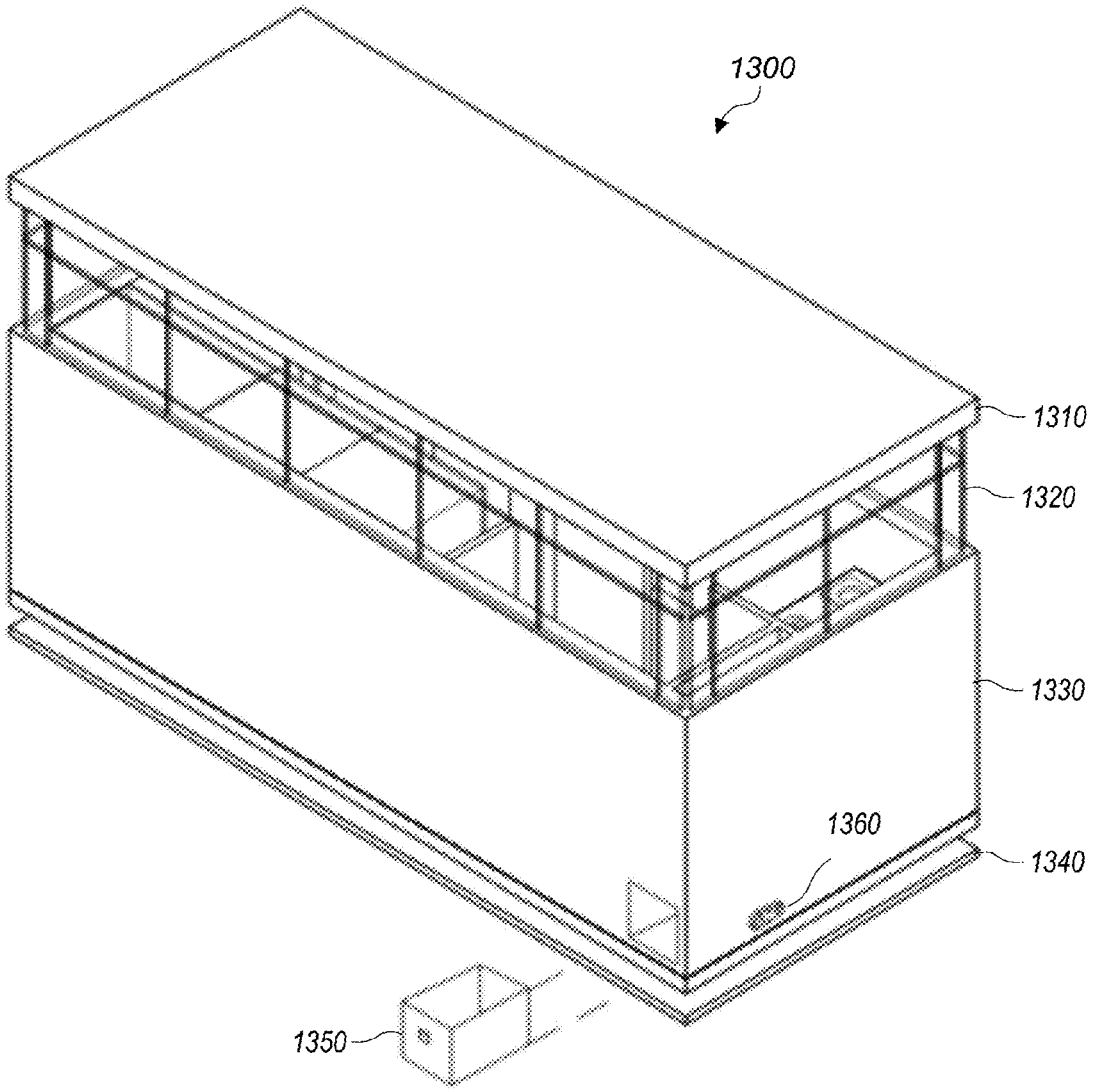
FIG. 13 illustrates a modular, stackable housing unit with a removable waste container suitable for storing waste when the modular, stackable housing unit is off-frame, according to some embodiments.

FIG. 13 illustrates a modular, stackable housing unit 1300 with a removable waste container 1350 suitable for storing waste when the modular, stackable housing unit is off-frame, according to some embodiments. In at least the illustrated embodiment, modular housing unit 1300 is configured with a raised roof 1310 above a glass surround 1320. The modular housing unit is also depicted with an end wall 1330 that is configured with a utility connector 1360 (e.g., similar to the utility connector depicted in FIG. 19, described below). The modular housing unit 1300 is also configured with a double-plate foundation 1340 as well as a removable waste container 1350. In some embodiments, the removable waste container 1350 may be configured to store waste while the unit is not connected to the utilities and/or other systems of the rack. For example, in some embodiments, the modular housing unit may be configured to provide a livable environment apart from the rack system. The removable waster container 1350 may be configured to store waste while the modular housing unit is not connected to a waste removal system, in embodiments. In some embodiments, the removable waster connector may be coupled to the utility connector. In some embodiments, the waste container may be configured as part of the utility connector. In some embodiments, the waste container may be distinct from the utility connector.

Figure 14A:
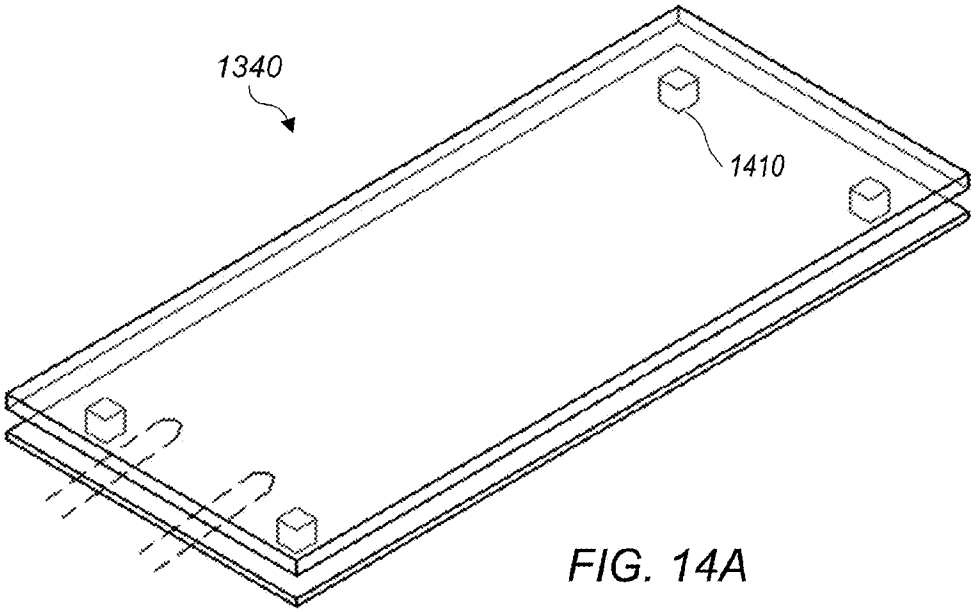
FIGS. 14A-C illustrate a double-plate foundation for a modular, stackable housing unit, according to some embodiments.
Figure 14B:
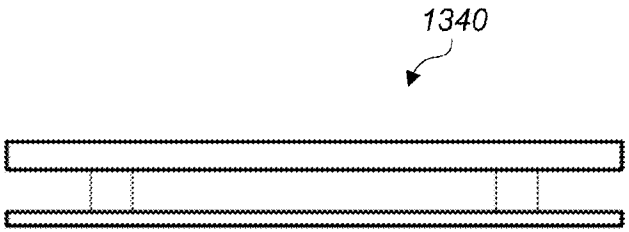
Figure 14C:
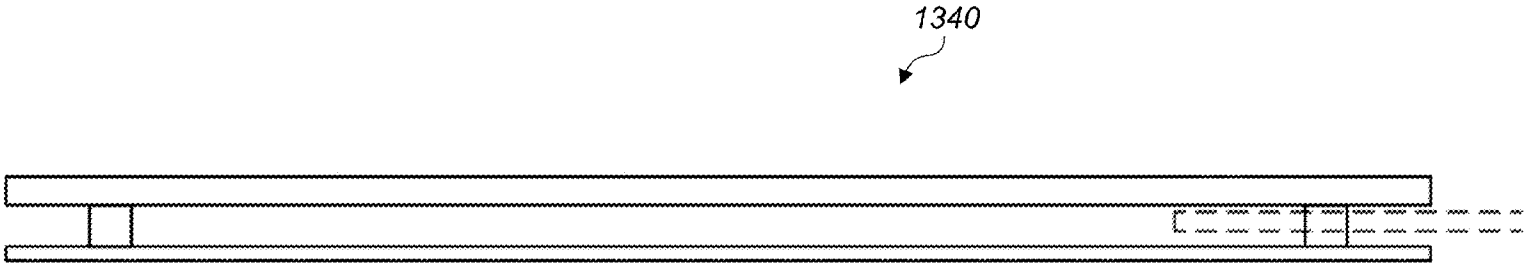

FIGS. 14A-C illustrates a double-plate foundation for a modular, stackable housing unit, according to some embodiments. In the depicted embodiment, the dotted lines illustrate the forks of a fork lift placed in-between the double-plate system such that the fork lift can lift the double-plate foundation. FIG. 14A illustrates that the two parallel plates may be coupled together via blocks 1410. Although illustrated with four connecting blocks in the illustrated embodiment, the double-plate foundation system 1340 or configuration may also be configured with more of fewer connecting blocks, by a webbed framework or the like. In some embodiments, the double-plate foundation system may be configured with a leveling mechanism between the two plates (or as legs that protrude above or below the double-plate foundation, in some embodiments). For example, the connecting blocks may be configured with pins and corresponding holes such that the blocks may be lengthened or shortened. In another example, the connecting blocks may be configured from a hydraulic system (e.g., that controls the distance between the plates individually at each block location). Other leveling mechanisms may be used (e.g., screw-type leveling, etc.) to level the foundation (e.g., after the modular housing unit has been placed into the rack or when the modular housing unit is used outside of the rack), in embodiments. FIG. 14B illustrates an end view of the double plate system 1340. FIG. 14C illustrates a side view of the double-plate system 1340, in embodiments.

Figure 14D:
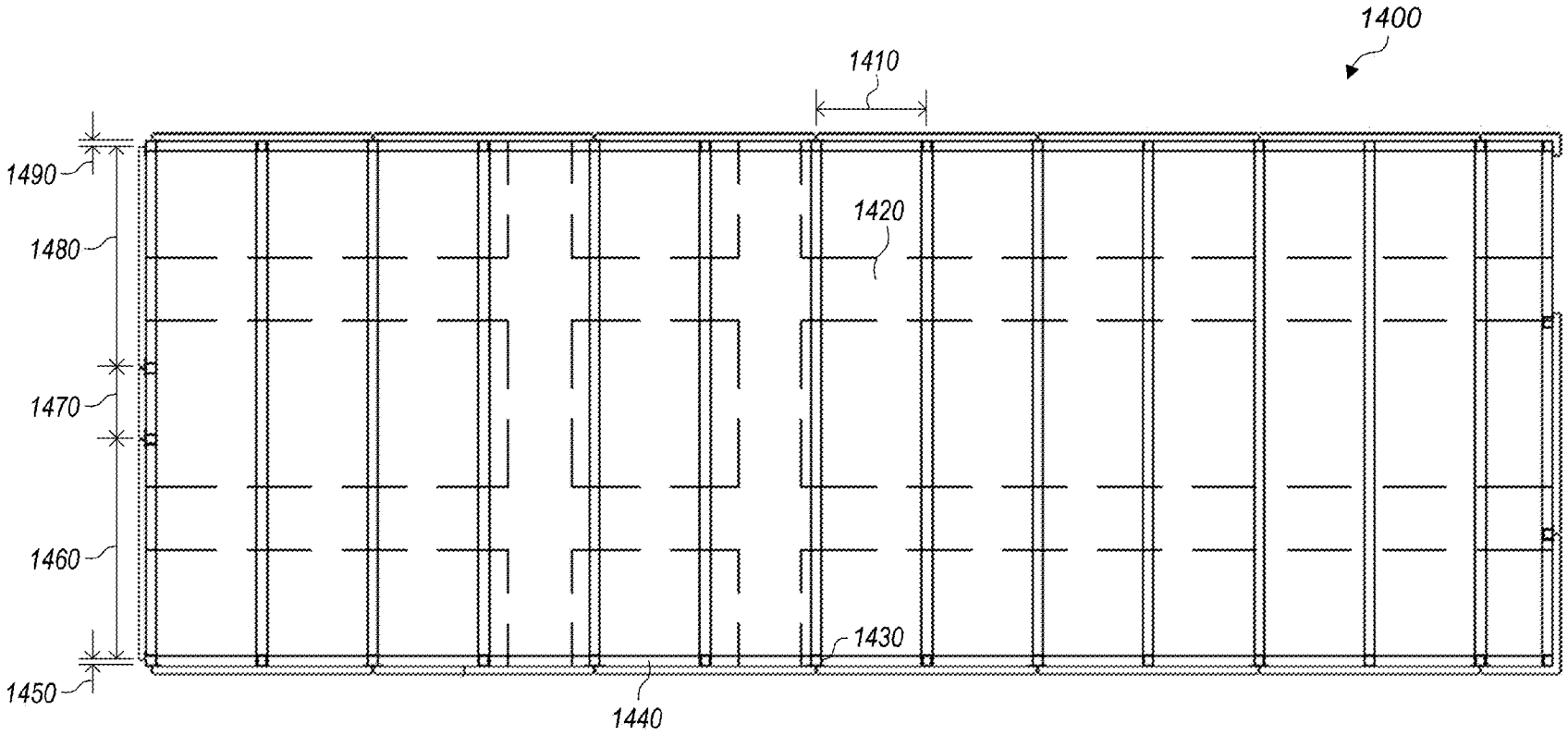
FIG. 14D illustrates a top-down view of the framework for a modular housing unit, in some embodiments.

FIG. 14D illustrates a top-down view of the framework for a modular housing unit, in some embodiments. In the illustrated embodiment, studs 1410 are spaced at intervals. The modular housing unit 1400 may be configured in a variety of various configurations and dimensions (e.g., configurations and dimensions 1420-1490).

Figure 15:
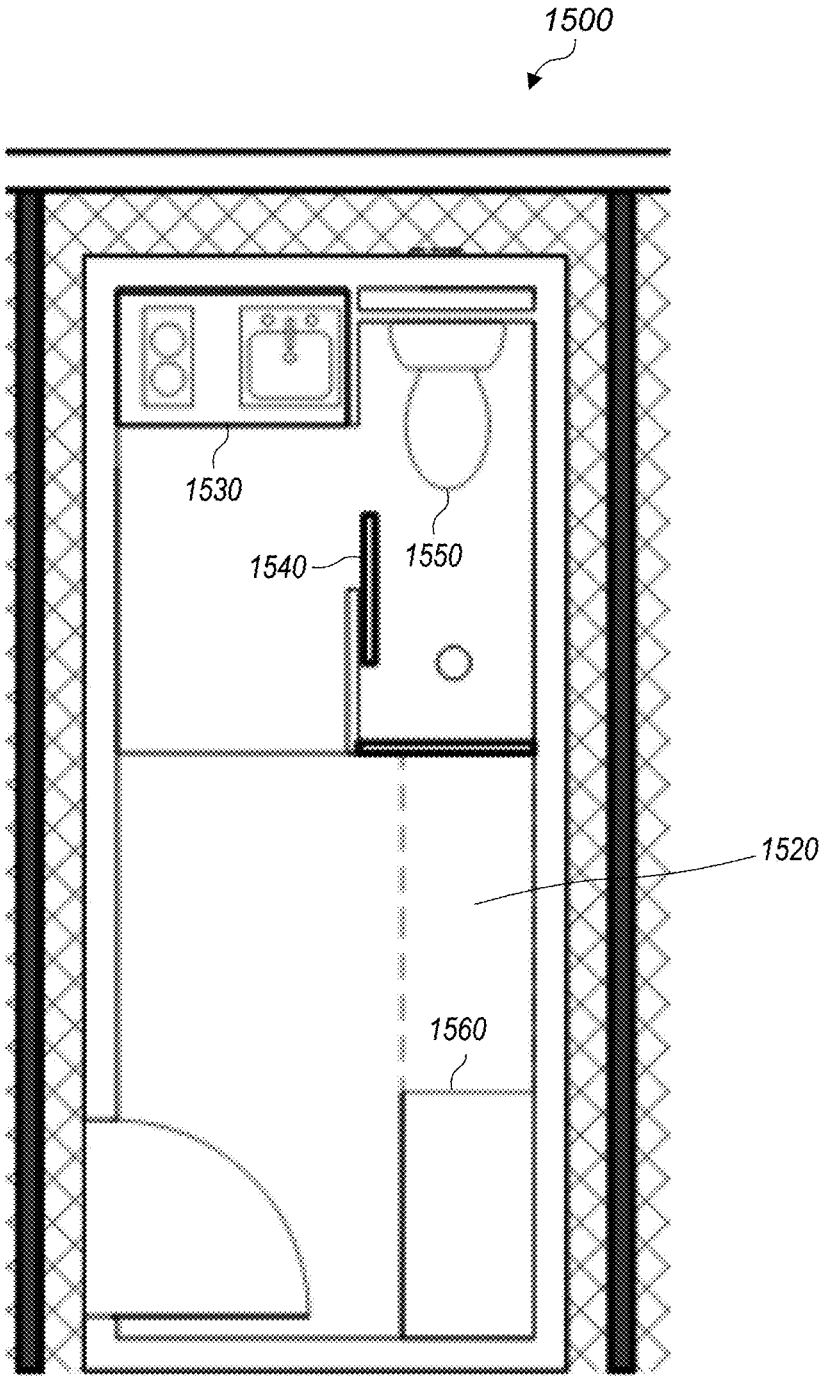
FIG. 15 illustrates modular, stackable housing unit that fits in a parking spot, according to some embodiments.

FIG. 15 illustrates modular, stackable housing unit that is configured to fit in a parking spot 1500, according to some embodiments. Modular housing unit 1520 is illustrated with kitchen unit or system 1530 that includes a sink and cook top as well as sliding door 1540 between the kitchen area and the restroom with toilet 1550. A closet area 1560 may be included. Features described elsewhere in this specification may be configured as part of the modular housing unit, in embodiments.

Figure 16:
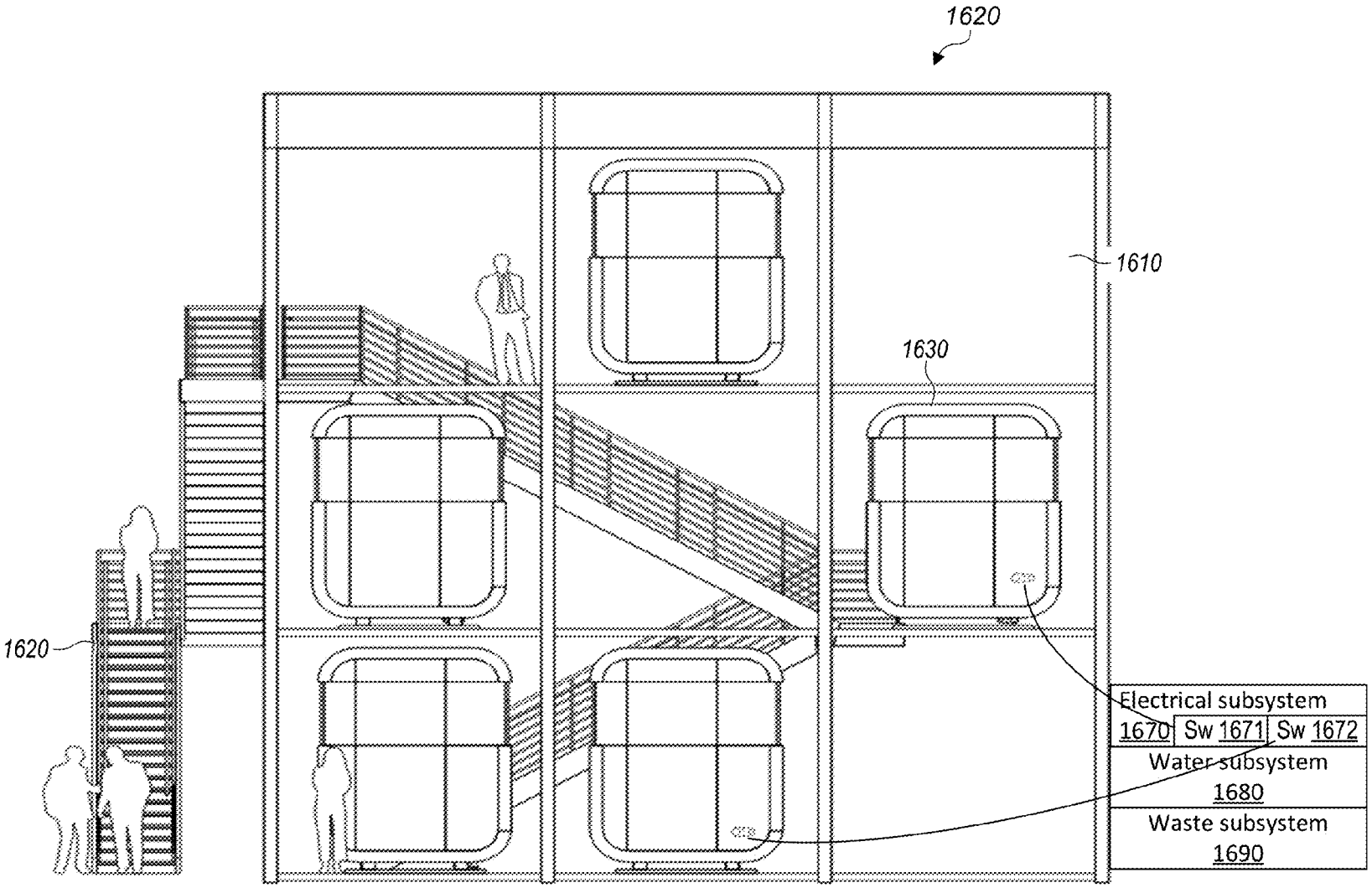
FIG. 16 illustrates a rack system that supports numerous modular, stackable housing units, according to some embodiments.

FIG. 16 illustrates a rack system that supports numerous modular, stackable housing units, according to some embodiments. The illustrated embodiment depicts a multi-unit housing system 1620 with rack 1610 that is configured with nine available locations for supporting individual housing units. The system is configured with stair system 1620 and depicts four individual modular housing units (e.g., 1630) that have been placed into the rack 1610. Rack subsystems 1670 (electrical), 1680 (potable water) and 1690 (waste) are also illustrated. The rack subsystems may include features to attach the subsystems to individual modular units 410. For example, electrical subsystem 1670 is illustrated with switches 1671 and 1672 that each may be controlled independently of the other electrical switches.

Figure 17:
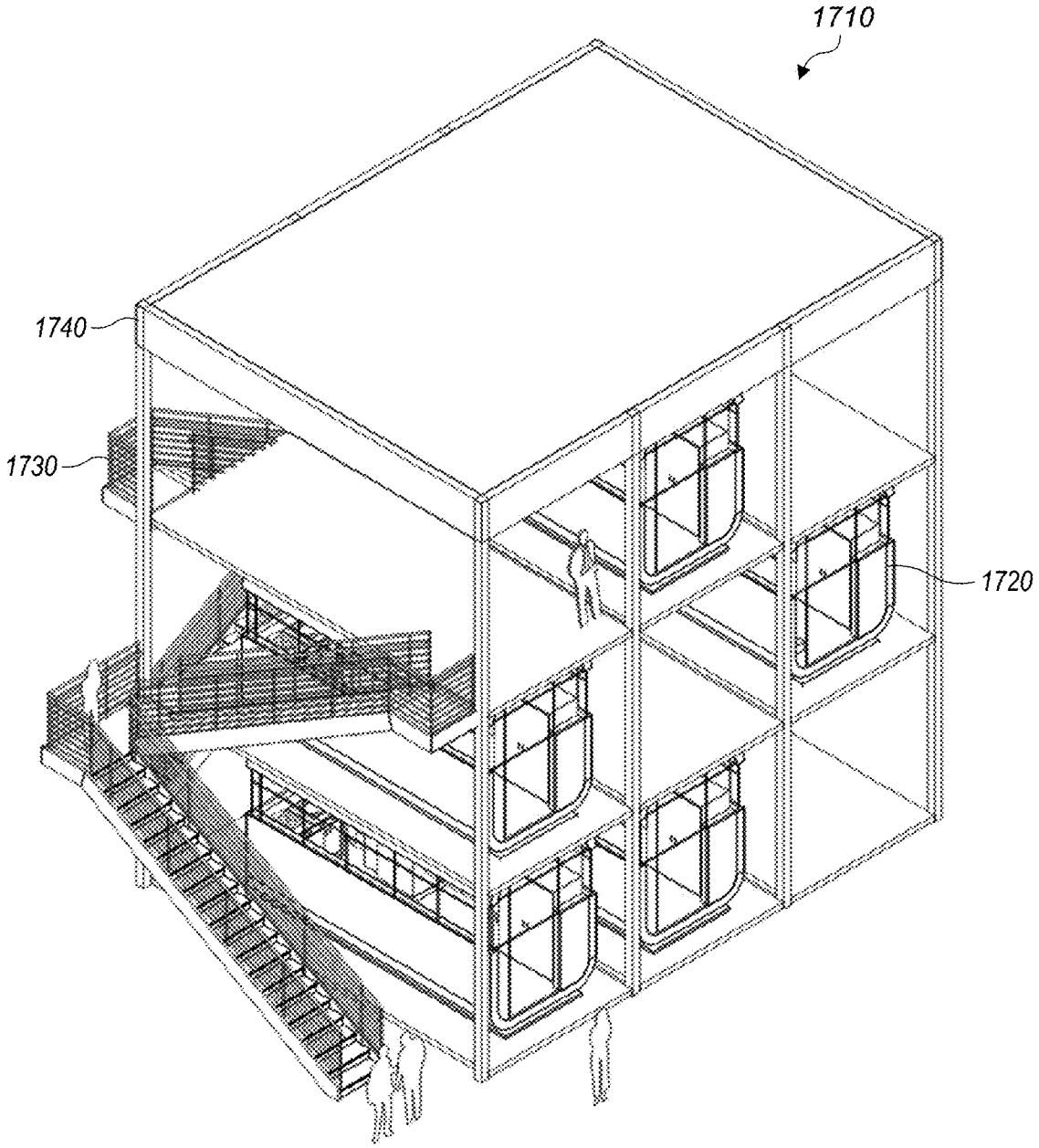
FIG. 17 illustrates a rack system supporting numerous insertable and removable modular, stackable housing units, according to some embodiments.

FIG. 17 illustrates a rack system 1710 supporting numerous insertable and removable modular, stackable housing units 1720, according to some embodiments. In some embodiments, the rack system may include a spiral staircase. Holes in the floor for the staircase may be filled with manhole covers, in embodiments. FIG. 17 illustrates a triangulated stair system 1730 where one end of the triangulated staircase is on one level of the rack and another end of the triangulated staircase is on another level of the rack and one point of the triangulated staircase is coupled to another staircase. In some embodiments, the staircase may be modular. For instance, the staircase may be a prefabricated unit that can be coupled to the rack system.

Figure 18:
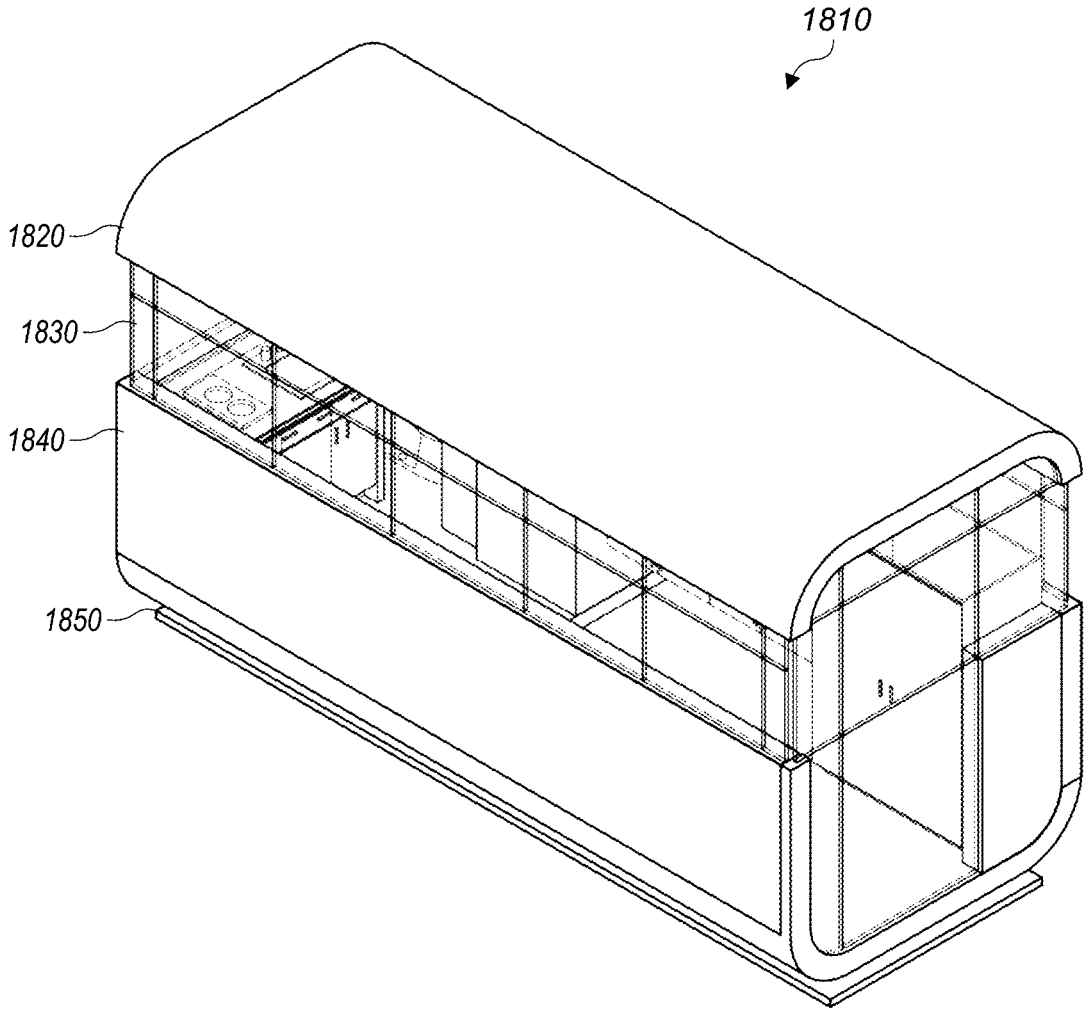
FIG. 18 illustrates a modular, stackable housing unit, according to some embodiments.

FIG. 18 illustrates a modular, stackable housing unit 1810, according to some embodiments. In the illustrated embodiment, the housing unit 1810 is depicted with a curved shell 1820. Modular housing unit 1810 is depicted with a glass surround 1830, curved wall 1840 and double-plate foundation 1850 (e.g., similar to the double-plate foundation depicted in FIG. 14A-C.

Figure 19:
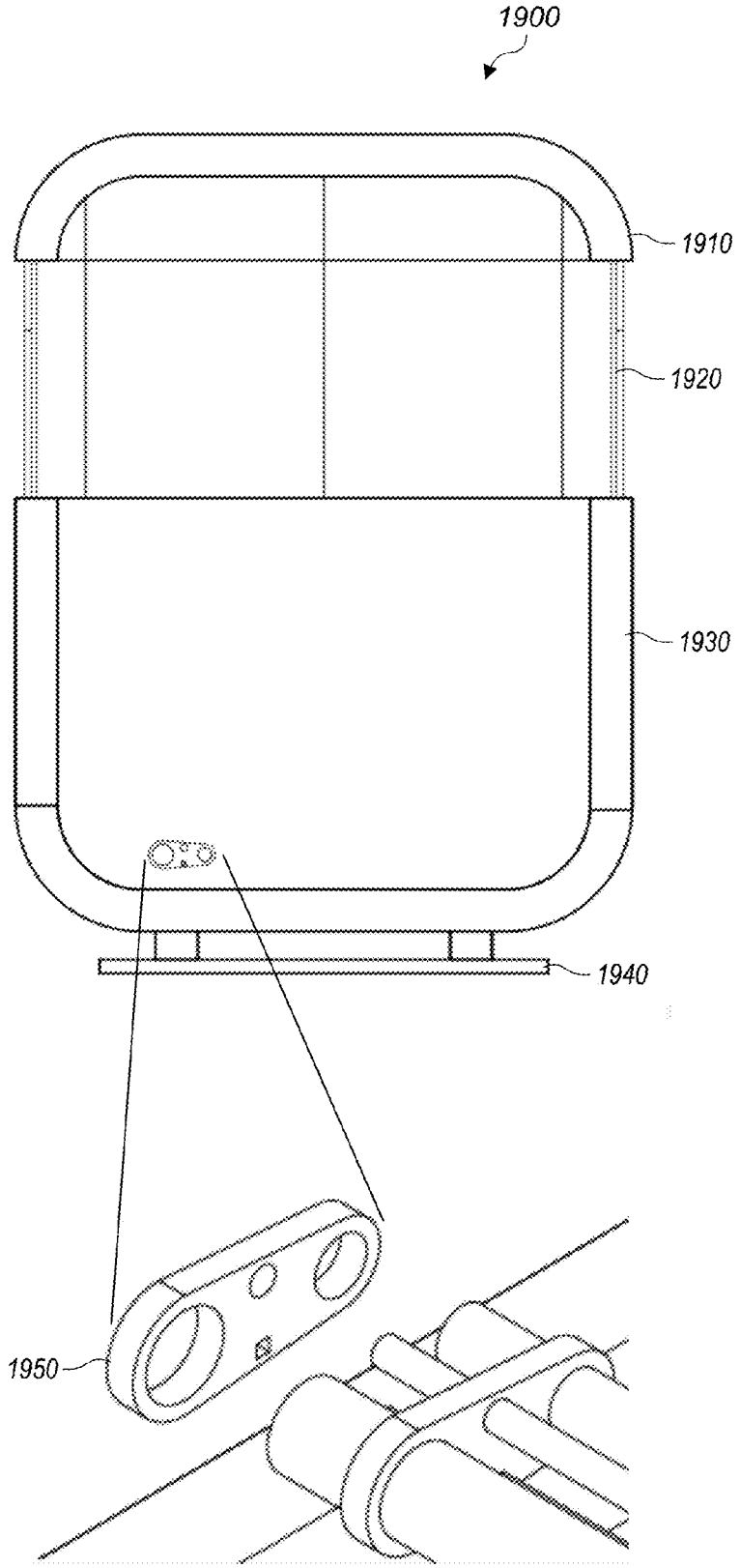
FIG. 19 illustrates a modular, stackable housing unit with a connector, according to some embodiments.

FIG. 19 illustrates a modular, stackable housing unit with a connector, according to some embodiments. In the depicted embodiment, the modular housing unit 1900 may be configured with connector collar 1950. The connector collar 1950 (connector collar 1950 may be referred to as utility receptacle, in embodiments) may be coupled to the modular housing unit 1900 by any of various ways. For example, the connector collar 1950 may be welded to the modular housing unit, glued to the modular housing unit, bolted to the modular housing unit, riveted to the modular housing unit, or the like. The connector collar may be configured to couple with a plug (e.g., a utility plug), in embodiments. The plug may be configured with one or more sub-connectors, for example, sub-connectors for electricity, natural gas or propane, potable water, waste, Internet or the like. In the depicted embodiment, the utility receptacle is configured with three distinct utility holes and a mounting hole. In some embodiments, the largest hole may be configured for wastewater, the medium hole for potable water and the smallest circle for electrical connections. The small square represents an alignment hole, in embodiments.

In some embodiments, the utility plug and the utility receptacle may be configured such that when coupled, multiple distinct systems are coupled at once. In some embodiments, various types of sub-connectors may be used. For example, either of the collar or the plug may be configured with mechanisms that seal the particular subsystem when the plug and the receptacle are separated. For example, a subsystem that transports or provides liquids may be configured with any of various mechanisms that seal either or both of the modular housing unit subsystem or the rack system end of the coupling when the plug and receptacle are decoupled. In some embodiments the connector itself of a portion of the subsystem relatively close to the connector may be configured with mechanisms (e.g., plumbing fittings such as ball valves or the like) that close of the water supply while the connector is disconnected and that can be opened once the connection has been made between the rack subsystem and the modular housing unit subsystem. In some embodiments, the either or both of the rack subsystems and the modular housing unit subsystems may be fitted with pluggable clamps and/or isolation valves to prevent leaks while the subsystems are disconnected. In some embodiments, the subsystems of either may be fitted with cleanouts.

In embodiments, the plug may be configured as a one-piece unit that includes sub connections for a number of subsystems of the modular housing unit that are connectable to corresponding subsystems of the rack system. In various embodiments, the plug may be configured to slidably connect. In some embodiments, the plug may be configured to be coupled to the collar via other fastening mechanisms, such as bolts, clips, spring loaded arms, or the like. In embodiments, the plug may be configured with any combination of male and female ends. For example, the potable water subsystem end may be a female end and the wastewater subsystem end of the plug may be a male end, in embodiments.

It is contemplated that the plug and/or subsystems that the plug connects may be made from any various materials, in any combination. In some embodiments, the electrical sub system may be connected via a plug and socket that are distinct from the water-based subsystems.

In some embodiments, the rack may include a plurality of prefabricated modular housing units, each of the plurality of prefabricated modular housing units including: a modular unit electrical subsystem; a modular unit potable water subsystem; a modular unit wastewater subsystem; and a modular unit docking connector coupled to the respective modular housing unit and coupled to each of the respective modular unit subsystems; a rack for supporting the plurality of prefabricated modular housing units, the rack including: a rack electrical subsystem; a rack potable water subsystem; a rack wastewater subsystem; and a plurality of locations for supporting the plurality of modular housing units, each of the plurality of locations including a respective rack docking connector coupled to the rack and coupled to each of the respective rack subsystems; wherein the modular unit docking connector is configured to slidably couple with one of the plurality of rack docking connectors.

In embodiments, the modular unit docking connector is configured to slidably couple with one of the plurality of rack docking connectors as the respective modular unit is placed into the rack.

In some embodiments, each location on the rack is configured with alignment components that align the modular unit docking connector with the respective docking connector as the respective modular unit is placed into the rack.

In some embodiments, the modular unit docking connector is a female connector and the rack docking connector is a male connector configured to slide into the female connector.

In some embodiments, the modular unit docking connector is a male connector and the rack docking connector is a female connector configured to accept the male connector into the female connector.

In another example, a rack may include a prefabricated modular housing unit including: a modular unit electrical subsystem; a modular unit potable water subsystem; a modular unit wastewater subsystem; and a modular unit docking connector coupled to the respective modular housing unit and coupled to each of the respective modular unit subsystems, wherein the modular docking connector is configured to couple to a rack docking connector.

In some embodiments, the modular unit docking connector is configured to slidably couple with a rack docking connector as the prefabricated modular housing unit is placed into a rack.

In some embodiments, the modular unit docking connector is a female connector and the rack docking connector is a male connector configured to slide into the female connector.

In some embodiments, the modular unit docking connector is a male connector and the rack docking connector is a female connector configured to accept the male connector into the female connector.

In some embodiments, the modular unit wastewater subsystem of the prefabricated modular housing unit includes a wastewater tank for storing wastewater.

In some embodiments, the prefabricated modular housing unit is configured to use the wastewater tank when the modular unit docking connector is decoupled from the rack docking connector and to not use the wastewater tank when the modular unit docking connector is coupled to the rack docking connector.

In some embodiments, the modular unit docking connector is configured to seal one or more of the couplings to the modular unit potable water subsystem and the modular unit wastewater subsystem when the modular unit docking connector is decoupled from the rack docking connector.

In some embodiments, the modular unit electrical subsystem that the modular unit docking connector is coupled to is also coupled to a modular interior wall system of the prefabricated modular housing unit, the modular interior wall system comprising: a modular wall system framework for supporting a plurality of removable modular tiles, wherein the removable modular tiles are held in place to the modular wall system framework via magnetism, friction fit, or quick-release mechanism; and one or more removable modular tiles that are electrically coupled to the modular unit electrical subsystem and that provide one or more of: electrically-powered functionality, or an electrical connector for connecting electrically-powered devices.

In some embodiments, the electrical subsystem of the rack may include a breaker panel and/or transformer and/or inverter. The connector 1950 may be configured between the breaker panel and the transformer, in embodiments. In some embodiments, the connector may be configured with a main breaker as part of the connector.

In some examples the rack includes a rack for supporting the plurality of prefabricated modular housing units, the rack including: a rack electrical subsystem; rack potable water subsystem; a rack wastewater subsystem; and a plurality of locations for supporting a plurality of modular housing units, each of the plurality of locations including a respective rack docking connector coupled to the rack and coupled to each of the respective rack subsystems; wherein each of the plurality of rack docking connectors is configured to slidably couple with a modular unit docking connector of a prefabricated modular housing unit.

In some embodiments, the rack docking connector is configured to slidably couple with the modular unit docking connector as the prefabricated modular housing unit is placed into the rack.

In some embodiments, the rack docking connector is a female connector and the modular unit docking connector is a male connector configured to slide into the female connector.

In some embodiments, the rack docking connector is a male connector and the modular unit docking connector is a female connector configured to accept the male connector into the female connector.

In some embodiments, each of the plurality of locations on the rack is configured with alignment components that align the modular unit docking connector with the respective docking connector as the respective modular unit is placed into the rack.

In some embodiments, the rack electrical subsystem includes: a plurality of electrical switches corresponding to respective ones of the plurality of location on the rack, wherein each electrical switch is controlled independently of the other plurality of electrical switches.

In some embodiments, the rack docking connector is configured to seal one or more of the couplings to the rack potable water subsystem and the rack wastewater subsystem when the modular unit docking connector is decoupled from the rack docking connector.

Some embodiments may include a rack docking slide mechanism that may include a roller assembly and/or an attachment assembly. For example, the roller assembly may include a tray that rolls out of the rack assembly such that a modular housing unit can be place onto the tray, affixed (e.g., by the attachment assembly such as bolts or the like) to the tray and the tray slid back into the rack assembly. The connector illustrated in FIG. 19 may slidably couple the modular housing unit to the utility systems of the rack as the rack docking slide mechanism slides back into the rack, in embodiments. In other embodiments, the modular housing unit may be coupled to the rack utility system via the connector before or after the modular housing unit is placed on the rack docking slide.

In some embodiments, the male/female connections for the waste water and the potable water may be arranged with a female connector for one and a male connector for the other on one end of the connecting device and the corresponding male connector and female connector on the other end of the connection (e.g., on the modular housing device).

In some embodiments, the connector may include a connection for Internet-connectivity (e.g., fiber or coaxial or twisted pair).

Figure 20:
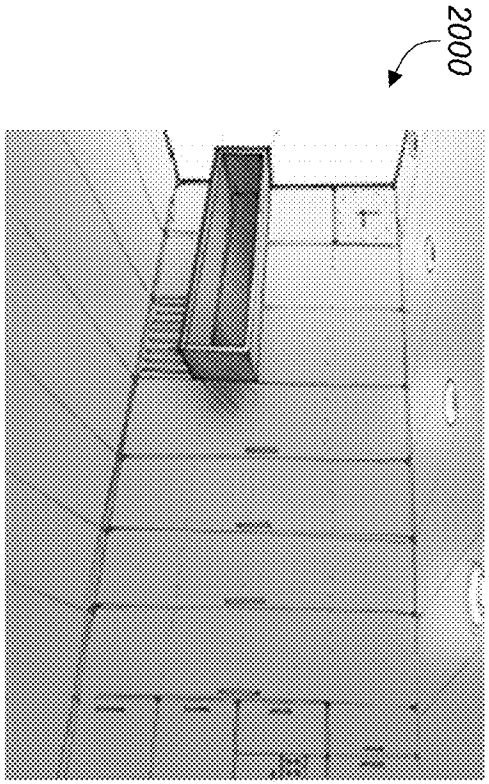
FIG. 20 illustrates a modular interior wall system, according to some embodiments.

FIG. 20 illustrates a modular interior wall system, according to some embodiments. In the depicted embodiment, the interior 2000 is illustrated with modular wall unit closets of various sizes and a modular shelf and a modular clock. In embodiments, the interior wall may be configured such that the closets, shelf, clock and the like may be moved and mixed and matched as part of a modular interior wall system that include various tiles that can be removed, replaced, moved, etc.

Figure 21B:
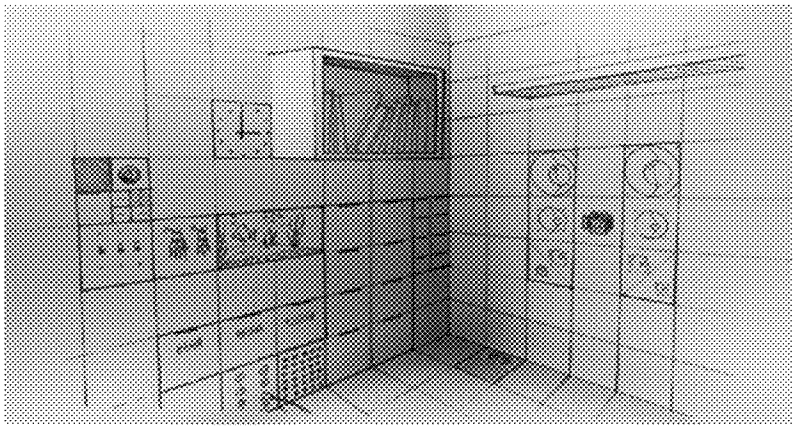
FIGS. 21A-B illustrate a modular interior wall system, according to some embodiments.
Figure 21A:
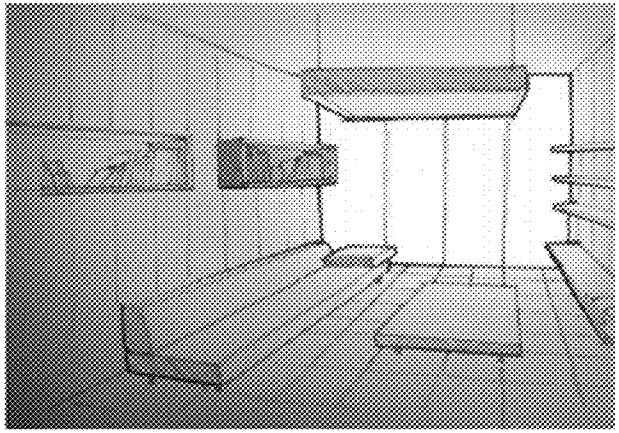

FIGS. 21A-B illustrate a modular interior wall system, according to some embodiments. The illustrated embodiments depict various wall configurations for an interior wall system of a modular housing unit. FIG. 21A illustrates shelves that may be affixed to the wall as part of the tile-based modular wall system 2120, 2140 described herein. For example, the shelves may be affixed to the wall using attachments similar to those illustrated and described herein for use with the modular tile system.

FIG. 21B illustrates another modular housing interior wall section with various tiles arranged in a modular framework. Each individual tile may be configured with distinct functionality or aesthetics. Example illustrated tiles in tiles configured with clock functionality, radio functionality, speaker functionality, shelving functionality, electrical outlet functionality, etc. In some embodiments, tiles may be configured aesthetically, such as with colors, drawings, pictures, photographs, electronic displays, etc. Some tiles may include combinations of functionality and aesthetics.

Figure 22A:
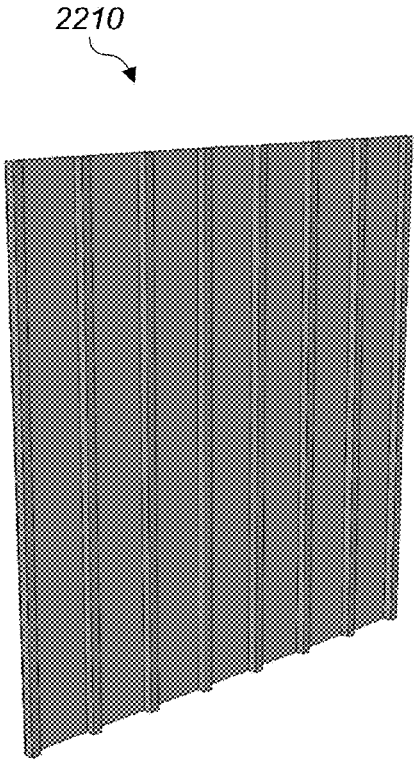
FIGS. 22A-C illustrates components of a modular interior wall system, according to some embodiments.
Figure 22B:
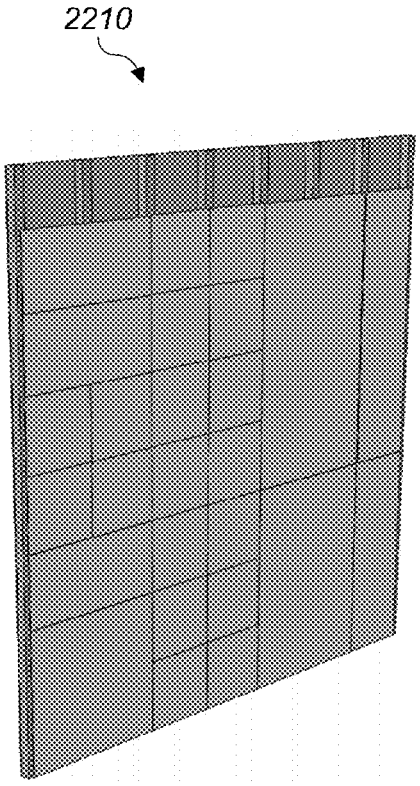
Figure 22C:
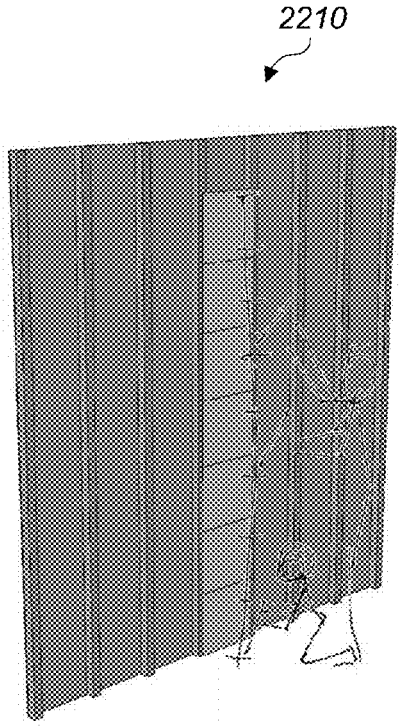

FIGS. 22A-C illustrates components of a modular interior wall system, according to some embodiments. FIG. 22A illustrates an interior wall system with a framework (e.g. metal or wood studs) that are spaced at a distance that facilitates connection of the tiles to the framework. FIG. 22B illustrates an interior wall system that includes tiles arranged on the interior wall framework of 22A. In the illustrated embodiment, tiles may be of various sizes. The various sizes may be in multiples of a base size. For example, in one example with a 13 inch base tile size, tiles may be sized 13×13, 13×26, 26×13, 39×13, 26×26, etc. FIG. 22C illustrates that the tiles may be snapped into place on the framework illustrated in FIG. 22C.

Figure 23C:
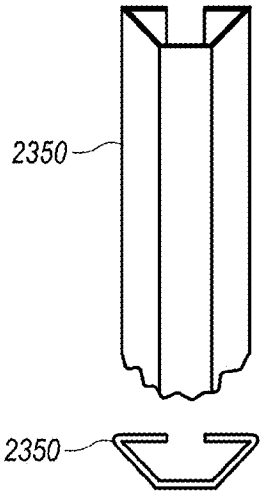
FIGS. 23A-D illustrates components of a modular interior wall system, according to some embodiments.
Figure 23B:
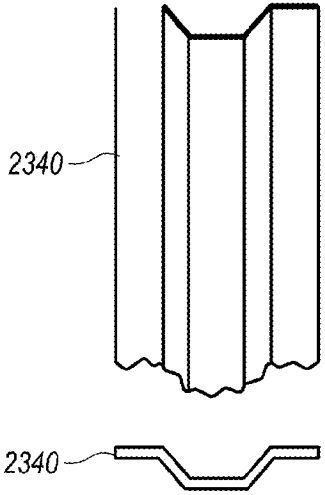
Figure 23D:
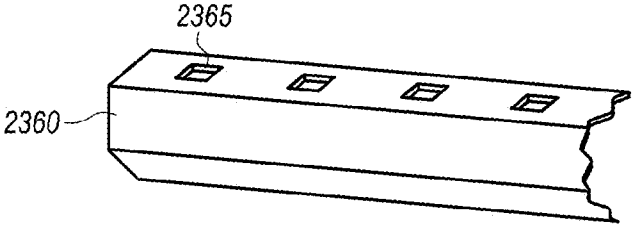
Figure 23A:
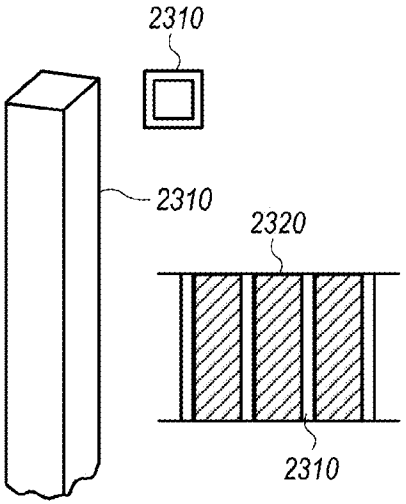

FIGS. 23A-D illustrate components of a modular interior wall system, according to some embodiments. FIG. 23A illustrates an example wall stud 2310 (e.g., for the wall in 22A, 14D, etc.) configured to be part of modular wall 2320 that has a square cross-section. FIGS. 23B & 23C illustrate studs 2340 and 2350 that have alternative configuration cross-sections. FIG. 23D illustrates a stud 2360 with holes 2365 that accept various mechanisms for attaching tiles to the studs. The spacing between the holes may be varied for some embodiments.

Figure 24C:
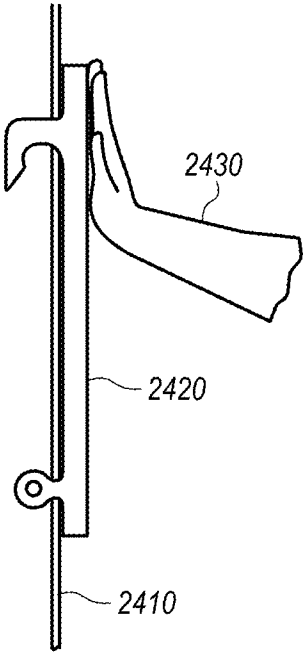
FIGS. 24A-C illustrate components of a modular interior wall system, according to some embodiments.
Figure 24B:
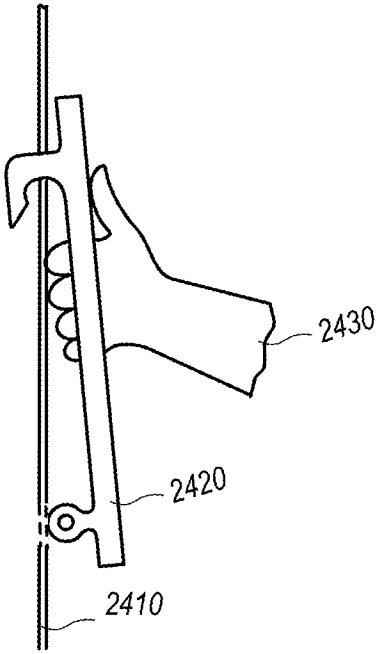
Figure 24A:
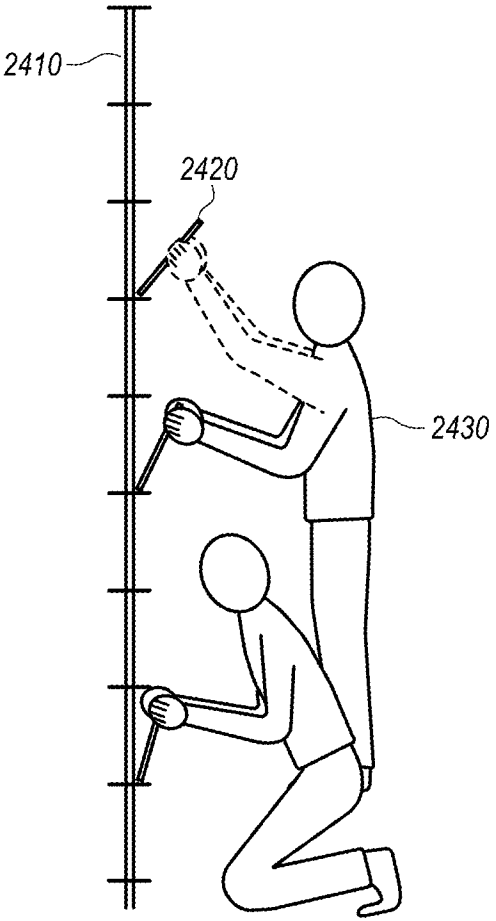

FIGS. 24A-C illustrate components of a modular interior wall system, according to some embodiments. Tile 2420 is illustrated. In FIG. 24A a tile 2420 is illustrated as being moved by a person 2430 from a lower position to and middle and then a higher position. FIG. 24C illustrates one example mechanism for attaching a tile 2420 to a modular wall system 2410. In the illustrated embodiment, tile 2420 is being place onto a wall stud (e.g., a wall stud as illustrated in 22A) via a hang and snap attachment mechanism that provides for readily-movable tiles within the modular wall system. Other attachment mechanisms are also contemplated. For example, attachment mechanisms that provide for release and attachment of tiles to the wall without the use of tools while still providing a reliable strong attachment or coupling to the wall. FIG. 24C illustrates the tile 2420 attached to the wall in the attached position.

Figure 25B:
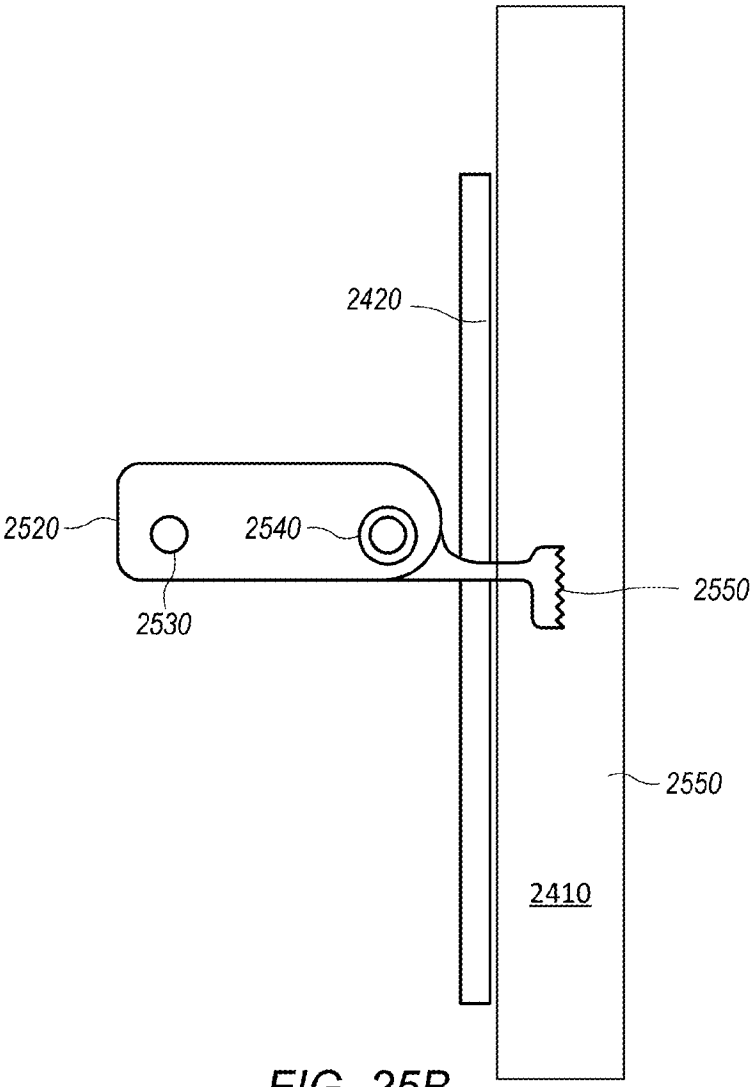
FIGS. 25A-B illustrate components of a latch system for a modular interior wall system, according to some embodiments.
Figure 25A:
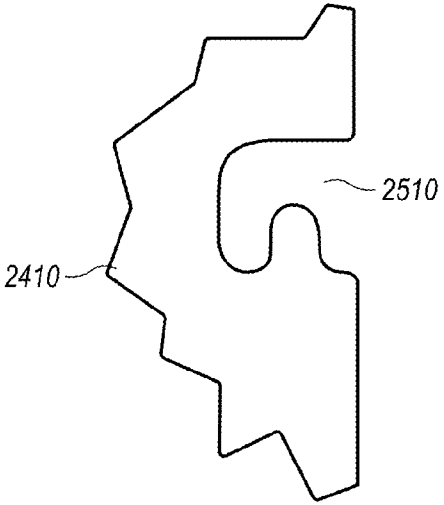

FIGS. 25A-B illustrate components of a latch system for a modular interior wall system, according to some embodiments. In the illustrated embodiment, wall system 22410 (e.g., a wall stud) of FIG. 25A is configured with a female tile connector receiver 2510. Such a mechanism may be configured and/or positioned on the stud of wall as a point of support for attaching a tile. FIG. 25B illustrates a male attachment mechanism 2520 that is configured to readily attach and detach a corresponding tile to and from the wall system. In some embodiments, the attachment mechanism 2520 is configured to work in concert with the female tile connector 2510 to provide a mechanism for attaching and detaching a tile to the modular wall system without the use of tools. In some embodiments, attachment mechanism 2520 is configured with a handle 2530 and pivot 2540 that when rotated about pivot 2540, tightens the tile 2420 to the stud 2550 of the modular wall system. In some embodiments, the attachment mechanism 2520 is configured to fit into the female tile connector 2510. In some embodiments, the male attachment mechanism may be a tool for attaching the tile to the wall. For example, the attachment mechanism 2520 may be configured to press the tile onto the wall and/or affix a tile to the wall with hardware (e.g., a nail, a screw, a rivet, or the like). In some embodiments, the attachment mechanism may be used to remove the tile from the wall (e.g., remove the hardware).

Figure 26C:
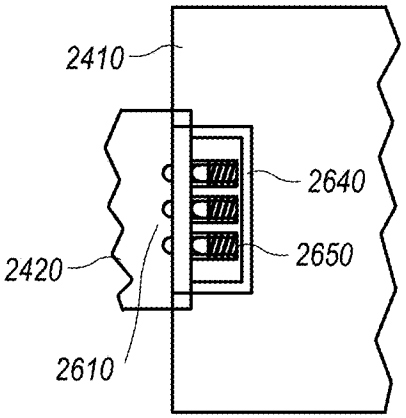
FIGS. 26A-C illustrate components of an electrical system for a modular interior wall system, according to some embodiments.
Figure 26B:
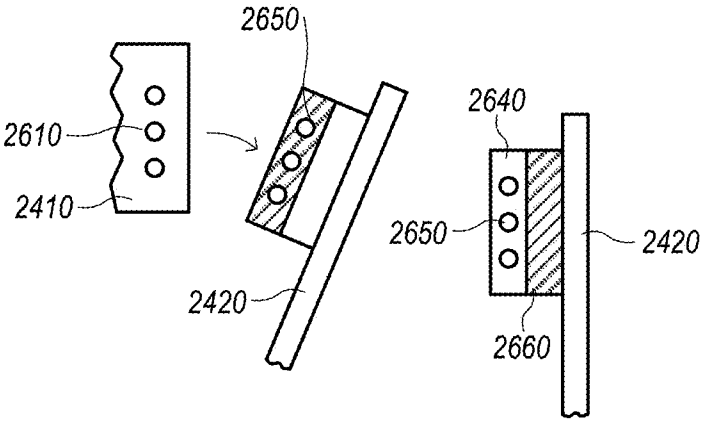
Figure 26A:
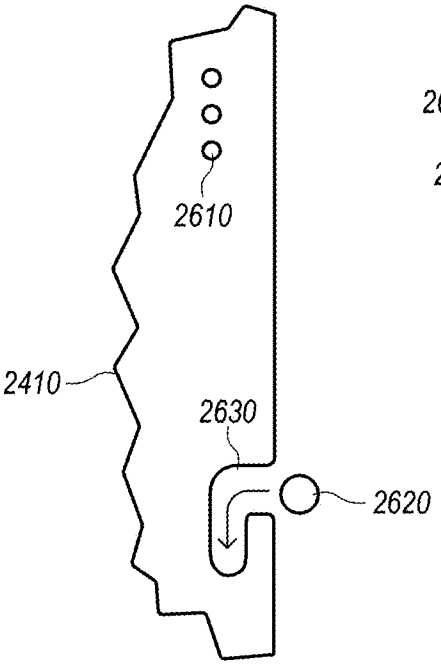

FIGS. 26A-C illustrate components of an electrical system for a modular interior wall system, according to some embodiments. In some embodiments, tiles that couple to the modular interior wall system are inductively charged (e.g., via magnetic posts and inductive technology). In some embodiments, the wall system may implement a daisy chain of inductive power. In the illustrated embodiment, wall or stud 2410 is configured with electrical power connections 2610 that activate an electrically-powered tile when the tile is snapped into place on the modular wall. For example, pin 2620 of a tile may be slid into place in hole 2630 such that the electrical connectors 2640 of the modular wall system are aligned with and form a connection to the corresponding electrical connectors 2650 of the tile 2420 that is being placed on the wall 2410. FIG. 26B illustrates a tile 2420 with a number of pins 2650 that make contact the electrical connectors 2610 of the modular wall when the tile 2420 is placed into position on the wall or stud 2410. Connector 2640 may be configured with insulating material 2660, in embodiments. FIG. 26C illustrates the electrical connectors 2610 of the tile making contact with the electrical connectors 2640 of the modular wall system while the tile 2420 is in place on the modular wall. In some embodiments, the electrical connectors may include spring-loaded pins 2650 that contact electrical contact patches and thereby form an electrical connection between the modular tile and the modular wall system.

Figure 27B:
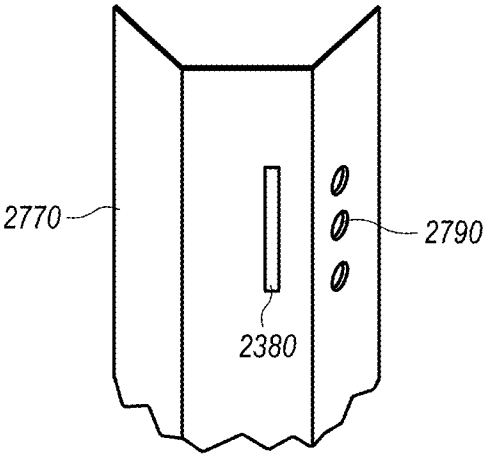
FIG. 27 A-B illustrate components of an electrical system for a modular interior wall system, according to some embodiments.
Figure 27A:
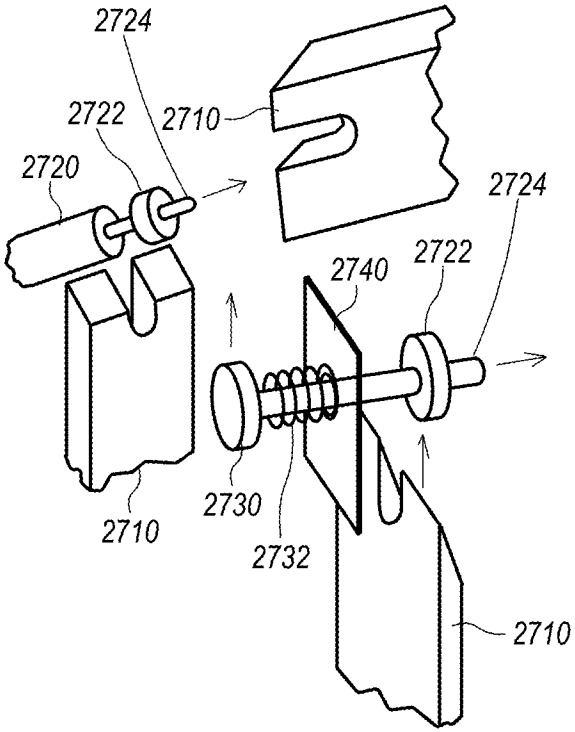

FIGS. 27A-B illustrate components of an attachment system for a modular interior wall system, according to some embodiments. FIG. 27A illustrates a spring-loaded connector mechanism that includes a pin body 2720, spring 2732, a pin head 2730 a mounting plate 2740 (e.g., a washer or the tile) and an angled receptacle 2710 (e.g., a wall stud) that are configured to work together to affix a tile onto the modular wall system. In some embodiments, the connector may be configured with or without the spring. In some embodiments, the connector may be configured as part of an electrical connector that provides an electrical connection between the tile and the modular housing unit's electrical system (e.g., via an interior wall system electrical subsystem of the module housing unit). For example, the connector mechanism may be configured with an insulated pin body 2722/2720 and an electrode 2724 for making an electrical connection (e.g., between the tile and the interior wall system electrical subsystem). In FIG. 27A, a tile is fitted with a spring-loaded connector that attaches a tile to a modular wall system (e.g., attaches a tile to a stud of a modular housing unit). In embodiments, the tile may be fitted with a number of spring-loaded connectors such that when the tile is placed against a modular wall or stud, receiving holes of the wall or stud receive the end of the spring loaded connectors. In the illustrated embodiment, the receiving wall or stud is configured such that the once the end of the spring-loaded connector is pushed through the opening of the receiving wall or stud, a catch mechanism on the back side of the wall or stud is angled such that the end of the spring-loaded connector rides on the angle and pulls the spring into tension.

FIG. 27B illustrates an example modular wall stud 2770 with electrical connectors 2790, tile support slot 2380.

Figure 28:
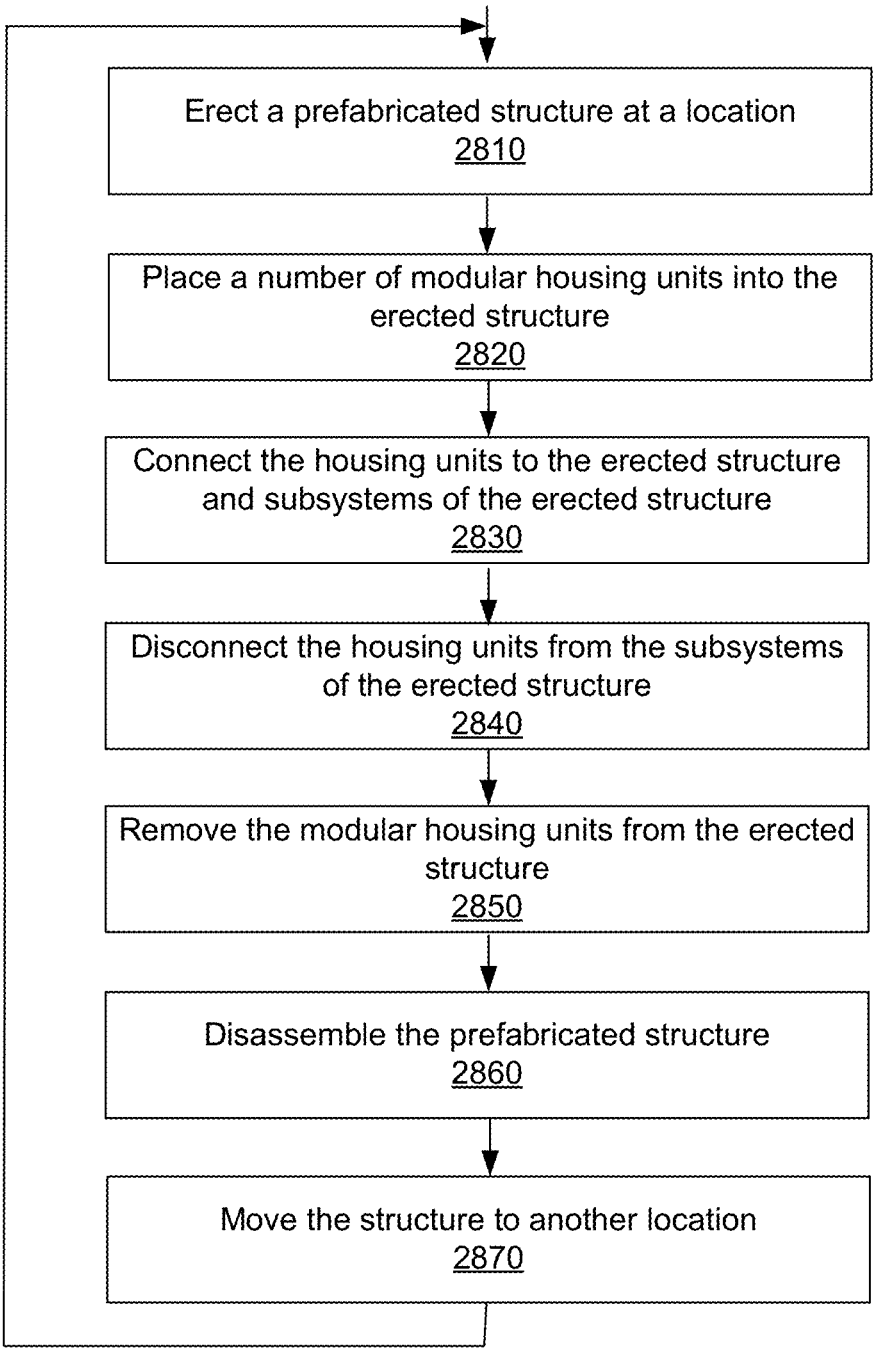
FIG. 28 illustrates a process of reusing a prefabricated support structure to support modular housing units at a series of different locations.

FIG. 28 illustrates a process of reusing a prefabricated support structure to support modular housing units at a series of different locations. For example, the underlying structure of the support structure may be configured such that the posts and beams can be readily attached and detached with hand tools. In some embodiments, the posts and beams of the structure can be attached and detached without damaging the posts and beams and such that the posts and beams can be transported to another location and re-assembled.

As illustrated in FIG. 28, a prefabricated structure is erected at a location (block 2810). For example, prefabricated components (e.g., posts and beams, although other construction materials are also contemplated) may be erected into a structure at a location. In some embodiments, any number of structure subsystems, such an electrical subsystem, potable water system, and/or a wastewater system, solar power system, etc. may be added to the erected structure.

A number of modular housing units may be placed into the erected structure (block 2820). For example, FIG. 11 illustrates that nine modular housing units 1102 have been placed into an erected structure 1108. In some embodiments, the modular housing units may be slid or placed into the structure via some mechanized transport devices such as a crane, a forklift, scissorlift or the like. In some embodiments, the structure may be configured with a tray system. For example, the erected structure may be configured with a tray in one or more of the locations that support the modular housing units. In embodiments, the tray may be configured to slide out of the location such that the modular housing unit can be placed onto the tray from above and the tray can be slide back into the location.

The modular housing units are connected to the erected structure and subsystems of the erected structure (block 2830). For example, once the modular housing unit is placed into the erected structure, the modular housing unit may be affixed in placed (e.g., pinned or bolted into place with the erected structure). The corresponding subsystems of the modular housing unit may be connected to the subsystems of the erected structure (or "rack").

The modular housing units may be disconnected from the subsystems of the rack (block 2840). For example, the electrical, potable water, and wastewater subsystems may be disconnected from the modular housing unit. As illustrated at 2850, the modular housing unit may be removed from the erected structure (or rack). For example, some lift mechanism may be used to lift the modular housing unit off of the tray or directly out of the location in the rack.

The prefabricated structure may be disassembled (block 2860). For example, the subsystems of the rack along with the posts and beams may be decoupled into individual components or components small enough to be transported to another location. The structure may be moved to another location (block 2870). For example, the structure may be moved to another geographical location, such as another city, another country, or the like.

In some embodiments, the process may repeat, using the same components of the prefabricated structure that were disassembled.

In some embodiments, the tile system is configured such that no matter which way the tile gets placed it will always line up with the powered terminals. In embodiments, the electrical system may be a 110V or 220V or 12V-based system. In embodiments, the electrical system may be configured with various inverters, converters or transformers. In some embodiments, the rack system or the modular housing unit may be configured with a solar-powered battery system. Any of the various components may be part of the rack or part of the modular housing unit, in various embodiments.

The various methods as illustrated in the Figures and described herein represent example embodiments of methods. The order of method may be changed, and various elements may be added, reordered, combined, omitted, modified, etc.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A system comprising:

a plurality of prefabricated modular housing units, each of the plurality of prefabricated modular housing units including:

a modular unit electrical subsystem, a modular unit potable water subsystem, and a modular unit wastewater subsystem, and a modular interior wall system that includes a modular wall system framework configured to support a plurality of removable modular tiles of a plurality of sizes arranged in a modular organization, wherein at least two of the plurality of removable modular tiles are supported via the modular wall system framework such that a side of a given one of the at least two tiles is coextensive with the side of another one of the at least two tiles, and the modular wall system framework includes electrical power connections that activate an electrically powered removable modular tile via an insulated pin body and an electrode when the electrically powered removable modular tile is coupled to the modular wall system framework via a plurality of spring-loaded connectors configured such that when the tile is placed against the modular wall system framework, receiving holes of the modular wall system framework receive the ends of the spring-loaded connectors and a catch mechanism pulls into tension a spring of the spring-loaded connector; and a rack for supporting the plurality of prefabricated modular housing units, wherein the rack is assembled from posts and beams into a supporting structure for the plurality of prefabricated modular units, the posts and beams are configured with connectors to be attached and detached with hand tools and decoupled into individual components without damage to the posts and beams, and the posts and beams of the supporting structure are configured to be disassembled and reassembled into the supporting structure, the assembled rack including:

a rack electrical subsystem;

a rack potable water subsystem;

a rack wastewater subsystem; and a plurality of locations for supporting the plurality of modular housing units.

2. The system of claim 1, wherein the system further comprises a modular unit docking connector coupled to the respective modular housing unit and coupled to each of the respective modular unit subsystems, and wherein the modular unit docking connector is configured to slidably couple with one of the plurality of rack docking connectors as the respective modular unit is placed into the rack; and the system further comprises a drainage system including a rainwater collecting roof that covers the rack and orients the collected rainwater out and away from the rack assembly via a drainpipe.

3. The system of claim 2, wherein each location on the rack is configured with alignment components that align the modular unit docking connector with the respective docking connector as the respective modular unit is placed into the rack, and the posts and beams are configurable so that a variable number of units may be accommodated by the rack using differing assemblies of posts and beams.

4. The system of claim 2, wherein the modular unit docking connector is a female connector and the rack docking connector is a male connector configured to slide into the female connector, and the system includes a railing for a rooftop gathering area.

5. The system of claim 2, wherein the modular unit docking connector is a male connector and the rack docking connector is a female connector configured to accept the male connector into the female connector, the system includes external cladding attached to the rack.

6. A device comprising:

a prefabricated modular housing unit including:

a modular unit electrical subsystem;

a modular unit potable water subsystem;

a modular unit wastewater subsystem;

a modular unit docking connector coupled to the respective modular housing unit and coupled to each of the respective modular unit subsystems, wherein the modular docking connector is configured to couple to a rack docking connector of a rack; and a modular interior wall system that includes a modular wall system framework configured to support a plurality of removable modular tiles of a plurality of sizes arranged in a modular organization, wherein at least two of the plurality of removable modular tiles are supported via the modular wall system framework such that a side of a given one of the at least two tiles is coextensive with the side of another one of the at least two tiles, and the modular wall system framework includes electrical power connections that activate an electrically powered removable modular tile via an insulated pin body and an electrode when the electrically powered removable modular tile is coupled to the modular wall system framework via a plurality of spring-loaded connectors configured such that when the tile is placed against the modular wall system framework, receiving holes of the modular wall system framework receive the ends of the spring-loaded connectors and a catch mechanism pulls into tension a spring of the spring-loaded connector.

7. The device of claim 6, wherein the modular unit docking connector is configured to slidably couple with the rack docking connector as the prefabricated modular housing unit is placed into the rack that includes the rack docking connector.

8. The device of claim 6, wherein the modular unit docking connector is a female connector configured to slidably couple with the rack docking connector.

9. The device of claim 6, wherein the modular unit docking connector is a male connector configured to slidably couple with the rack docking connector.

10. The device of claim 6, wherein the modular unit wastewater subsystem of the prefabricated modular housing unit includes a wastewater tank for storing wastewater.

11. The device of claim 10, wherein the prefabricated modular housing unit is configured to use the wastewater tank when the modular unit docking connector is decoupled from the rack docking connector and to not use the wastewater tank when the modular unit docking connector is coupled to the rack docking connector.

12. The device of claim 6, wherein the modular unit docking connector is configured to seal one or more couplings to the modular unit potable water subsystem and the modular unit wastewater subsystem when the modular unit docking connector is decoupled from the rack docking connector.

13. The device of claim 6, wherein the modular unit electrical subsystem that the modular unit docking connector is coupled to is also coupled to the modular interior wall system of the prefabricated modular housing unit, the modular interior wall system comprising:

one or more removable modular tiles that are electrically coupled to the modular unit electrical subsystem and that provide one or more of:

electrically-powered functionality, or an electrical connector for connecting electrically-powered devices.

* * * * *